US006810231B2

(12) United States Patent
Kobayashi et al.

(10) Patent No.: US 6,810,231 B2
(45) Date of Patent: Oct. 26, 2004

(54) SHEET TRANSFER APPARATUS AND IMAGE READING APPARATUS

(75) Inventors: Atsumi Kobayashi, Yamanashi-ken (JP); Kunihide Suzuki, Kofu (JP); Yutaka Tanaka, Yamanashi-ken (JP); Akiharu Higaki, Yamanashi (JP); Akihiko Tsukui, Yamanashi-ken (JP); Mizuho Shirakura, Yamanashi-ken (JP)

(73) Assignee: Nisca Corporation, Yamanashi-ken (JP)

( * ) Notice: Subject to any disclaimer, the term of this patent is extended or adjusted under 35 U.S.C. 154(b) by 48 days.

(21) Appl. No.: 10/397,257

(22) Filed: Mar. 27, 2003

(65) Prior Publication Data

US 2003/0210939 A1 Nov. 13, 2003

(30) Foreign Application Priority Data

Mar. 28, 2002 (JP) ..... 2002-093313

(51) Int. Cl.[7] ..... G03G 15/00; G03G 15/16; B65H 83/00; B65H 43/04

(52) U.S. Cl. ..... 399/367; 399/365; 399/369; 399/361; 399/363; 399/317; 271/3.14; 271/3.19; 271/4.01; 271/3.15; 271/145; 271/278; 271/213; 271/215; 271/220

(58) Field of Search ..... 399/367, 365, 399/369, 361, 363, 317; 271/3.14, 3.19, 4.01, 3.15, 145, 278, 213, 215, 220

(56) References Cited

U.S. PATENT DOCUMENTS 4,264,067 A * 4/1981 Adams et al. ..... 271/4.09
4,447,167 A * 5/1984 Euteneuer et al. ..... 400/625
5,940,659 A * 8/1999 Rieck ..... 399/124
6,011,936 A * 1/2000 Kaneko ..... 399/21
6,027,114 A * 2/2000 Watanabe et al. ..... 271/265.01
6,070,868 A * 6/2000 Nagato et al. ..... 271/145
6,206,359 B1 * 3/2001 Hirota et al. ..... 271/3.15
6,254,087 B1 * 7/2001 Johdai et al. ..... 271/184
6,428,000 B1 * 8/2002 Hara et al. ..... 271/223
6,601,842 B2 * 8/2003 Kobayashi et al. ..... 271/3.14
6,612,561 B2 * 9/2003 Sekine ..... 271/3.14
6,641,318 B2 * 11/2003 Yergenson ..... 400/625

FOREIGN PATENT DOCUMENTS

JP 03138259 A * 6/1991 ..... B65H/31/00
JP 11060044 A * 3/1999 ..... B65H/37/04
JP 2002-362778 12/2002
JP 2003006544 A * 1/2003 ..... G06F/17/60

OTHER PUBLICATIONS

Patent Abstract of Japan, Publication No. 09–292742, Publication date Nov. 11, 1997, Applicant Ricoh Co., Ltd.

* cited by examiner

*Primary Examiner*—Andrew H. Hirshfeld
*Assistant Examiner*—Marvin P. Crenshaw
(74) *Attorney, Agent, or Firm*—Manabu Kanesaka

(57) ABSTRACT

A sheet transfer apparatus transfers a sheet to a predetermined position. The apparatus includes a discharge tray; a support device for rotationally supporting the discharge tray; an interconnecting device that activates according to a rotation of the discharge tray; and a sheet regulating device engaging the interconnecting means to be movable between a regulating position for regulating a movement of the sheet and a retracted position for allowing the sheets on the discharge tray to move. A control device prevents the sheet regulating device from moving to the regulating position from the retracted position even though the discharge tray is rotated when a load greater than a predetermined value is applied to the sheet regulating device.

20 Claims, 20 Drawing Sheets

| SEN1 | SEN2 | SEN3 | SL(96) |
|---|---|---|---|
| ON | OFF | ON | ON |
| ON | ON | ON | OFF |

SHEET TRANSFER APPARATUS AND IMAGE READING APPARATUS

BACKGROUND OF THE INVENTION AND RELATED ART STATEMENT

This invention relates to a sheet transfer apparatus for an image reading apparatus such as a copier, facsimile, printer and scanner, and an image reading apparatus equipped with the same. More specifically, this invention relates to a sheet transfer apparatus having a discharge tray that stores a sheet after reading an image and is capable of opening a sheet transport path disposed below the discharge tray.

Japanese Patent Publication (Tokkai) No. 09-292742 has disclosed an example of a sheet transfer apparatus with a sheet transport path disposed below a discharge tray. In the apparatus, a transfer belt sequentially draws a sheet stacked on a sheet supply tray and transports the sheet to a platen glass to read an image on the sheet. The apparatus is structured to reverse and transfer the sheet via a switchback path to organize a page order of the sheet. The switchback path is arranged below the discharge tray.

In the conventional sheet transfer apparatus, it is difficult to recover a sheet when the sheet is not properly transferred, and causes a paper jam in the switchback path arranged below the discharge tray. The sheet is transferred back and forth in the switchback path with being curled, thereby being easy to cause the paper jam.

To make it easy to remove the jammed sheet, the discharge tray may be arranged to rotate upward to open the switchback path. A sheet transfer apparatus is generally capable of handling a sheet having a size from B5 to A3. The most commonly used sheet size is A4, and the switchback path may be arranged to open at a sheet transfer inlet.

In the case of the A4 size, the sheet is discharged on a part of the discharge tray after a reading process. In such a case, as shown in FIG. 21, when the discharge tray is rotated upward, the sheets P stacked on the discharge tray H slide, thereby shifting a bundle of the sheet and mixing up the page order. In the apparatus shown in FIG. 21, a sheet transfer path is arranged below the discharge tray. The same problem occurs for an image forming apparatus such as a copier or facsimile, in which a toner is disposed in the apparatus, and a discharge tray is rotated to open the apparatus to replace the toner.

In view of the problems describe above, the first object of the present invention is to provide a sheet transfer apparatus having a discharge tray for stacking a sheet discharged from the apparatus. When the discharge tray is opened upward while the sheets are stacked thereupon, the sheets are restrained not so as to slide, thereby preventing displacement of the sheet bundle and disorder of the pages.

The second object of the present invention is to provide a sheet transfer apparatus in which only a sheet having a size that tends to slide is restrained not so as to slide on the discharge tray, so that a sheet having a size that does not tend to slide is discharged smoothly without any obstacles.

Further objects and advantages of the invention will be apparent from the following description of the invention.

SUMMARY OF THE INVENTION

According to the first aspect of the present invention, a sheet transfer apparatus includes a discharge tray movable in the vertical direction between the first position for receiving a discharged sheet and the second position oblique with regard to the first position, interconnecting means that activates when the discharge tray moves from the first position to the second position, and sheet regulating means engaging the interconnecting means for regulate the sheet on discharge tray. An image reading apparatus is equipped with such a sheet transfer apparatus.

According to the second aspect of the present invention, a sheet transfer apparatus includes a discharge tray, support means for supporting the discharge tray to be rotatable, interconnecting means that activates when the discharge tray rotates, and sheet regulating means engaging the interconnecting means and movable between a regulating position for regulating a sheet on the discharge tray and a retracted position for allowing the sheet to move. An image reading apparatus is equipped with such a sheet transfer apparatus.

With the sheet regulating means in the sheet transfer apparatus of the invention, it is possible to open the discharge tray without disrupting or disorganizing the sheets stacked on the discharge tray.

The interconnecting means comprises cam means for interconnecting with the rotation of the discharge tray. One edge of the sheet regulating means engages the cam means. Also, the sheet regulating means is fixed at the regulating position when the cam means rotates more than a predetermined angle.

According to the present invention, the interconnecting means in the sheet transfer apparatus further comprises control means for preventing the sheet regulating means from moving from the retracted position to the regulating position even if the discharge tray is rotated when a load beyond a predetermined limit is applied to activate the sheet regulating means. With this configuration, the interconnecting means does not move due to a weight of the sheets covering the sheet regulating means when the discharge tray is rotated. The control means may include spring means or friction transmission means.

According to the present invention, a sheet transfer apparatus comprises a discharge tray having the first discharge tray for receiving a sheet discharged from a sheet discharge outlet and the second discharge tray arranged adjacent to the first discharge tray; support means for supporting the first discharge tray to be rotatable to open a lower portion of the discharge tray; interconnecting means that activates when the first discharge tray rotates beyond a predetermined angle; and sheet regulating means that engages the interconnecting means and moves between a regulating position for regulating the movement of the sheet placed on the discharge tray and a retracted position for allowing the sheet to move.

In the apparatus of the present invention, the sheet regulating means is supported on the second discharge tray, and the second supporting means supports the second discharge tray to be movable independently of the first discharge tray, thereby allowing the second discharge tray to open.

When a load beyond the predetermined amount is applied to the sheet regulating means, the interconnecting means controls the sheet regulating means to move from the retracted position to the regulating position.

According to the present invention, a sheet transfer apparatus comprises a discharge tray; transfer means for transferring a sheet along a platen for reading an image; a switchback path for switching and reversing the sheet transferred from the transfer means; a discharge tray composed of the first discharge tray arranged above the switchback path and being movable in a vertical direction between the first position for receiving the sheet after reading the image and the second position that opens the sheet transfer inlet side of the switchback path, and a second discharge tray disposed adjacent to the first discharge tray; support means for supporting the first discharge tray to be rotatably to open the switchback path; interconnecting means that activates according to the rotation of the first discharge tray; and sheet control means movable from a retracted position for allowing the sheet to move to a regulating position for regulating the movement of the sheet on the discharge tray through the action of the interconnecting means when the first discharge tray is rotated from the first position to the second position. An image reading apparatus is equipped with such a sheet transfer apparatus.

With this configuration, it is possible to easily remove the sheet jammed in the switchback path. The sheet regulating means also prevents the sheet placed on the discharge tray from slipping even when the discharge tray is lifted upward to open the switchback path, thereby maintaining the original state of the sheets on the discharge tray.

According to the present invention, the sheet transfer apparatus further comprises control means for interconnecting with the rotation of the first discharge tray so that the sheet regulating means does not move from the retracted position to the regulating position when the sheet is discharged and straddles between the first discharge tray and the second discharge tray above the sheet regulating means. Therefore, when a large size sheet such as A3 or B4 is placed beyond the first discharge tray to reach the second discharge tray, the sheet regulating means rises to prevent the sheet from being disorganized.

The first discharge tray and the second discharge tray are rotatably attached to a apparatus frame, thereby allowing an entire lower portion of the discharge tray to open.

According to the present invention, a sheet transfer apparatus comprises a discharge tray movable in the vertical direction between the first position for receiving a discharged sheet and the second position oblique with regard to the first position; a tray position sensor for detecting a location of the discharge tray at the first position or the second position; sheet regulating means for regulating the movement of the sheet on the discharge tray; drive means for driving the sheet regulating means to a position where the sheet regulating means engages the sheet; a sheet sensor disposed at upstream in the sheet discharge direction further than the sheet regulating means for detecting the sheet; and control means that actuates the drive means when the tray position sensor detects the discharge tray at the second position.

The sheet transfer apparatus further comprises the second sheet sensor for detecting whether the sheet on the discharge tray is located at downstream in the sheet discharge direction beyond the sheet regulating means. The sheet transfer apparatus further includes control means for preventing the drive means from activating when the second sheet sensor detects the sheets at downstream in the discharge direction, even when the tray position sensor detects the discharge tray at the second position. With this configuration, it is possible to easily remove a sheet jammed in the switchback path formed below the discharge tray. Furthermore, the sheet regulating means can maintain the original state of the sheet on the discharge tray without slipping out of place even if the discharge tray is lifted to open the switchback path and remove the jammed sheet.

DETAILED DESCRIPTION OF PREFERRED EMBODIMENTS

Hereunder, embodiments of the invention will be explained with reference to the accompanying drawings.

A sheet transfer apparatus 1 according to the present invention is mounted to a reading apparatus body via a hinge, arid the like (not shown) to be capable of opening and closing a platen disposed on an upper portion of an image forming apparatus 8.

Figure 1:
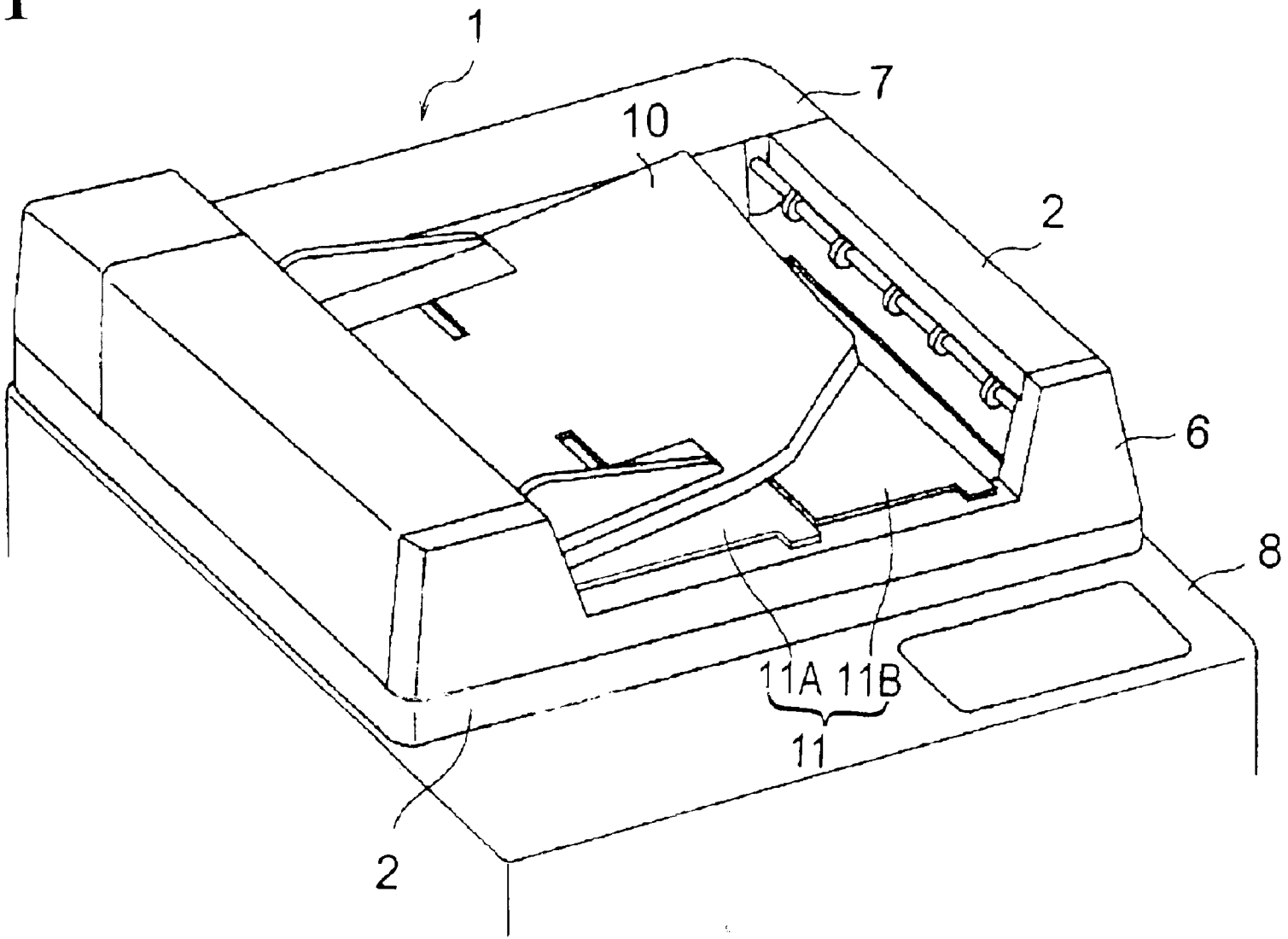
FIG. 1 is a top perspective view of a sheet transfer apparatus according to an embodiment of the present invention.
Figure 2:
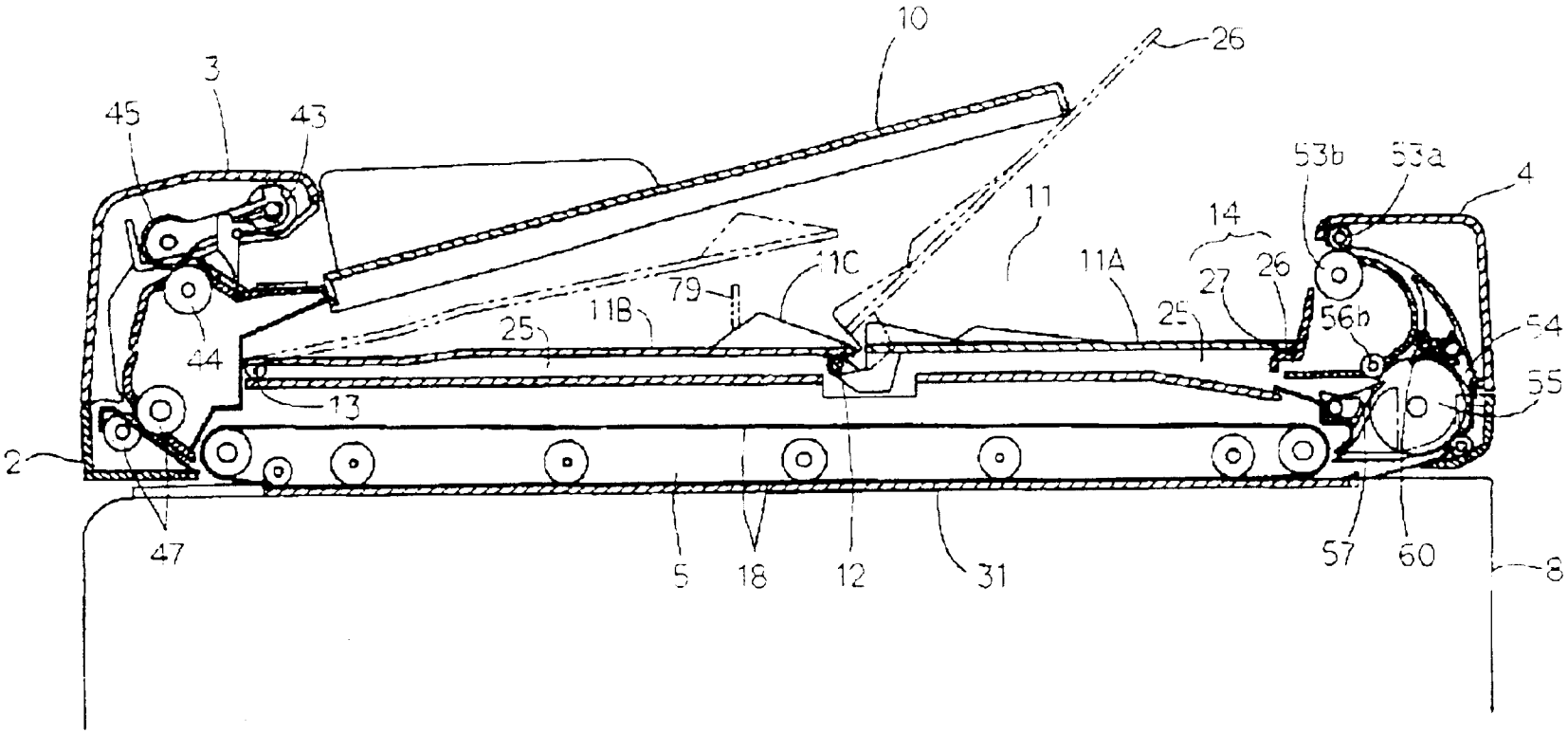
FIG. 2 is a front sectional view of the sheet transfer apparatus shown in FIG. 1.

FIG. 1 is a top perspective view of the sheet transfer apparatus 1 according to the present invention. FIG. 2 is a front sectional view of the sheet transfer apparatus seen. In the sheet transfer unit according to this invention, each of sheet supply means, transfer means and discharge means is configured as a unit.

On the sheet transport apparatus 1, as shown in FIG. 1 and FIG. 2, there are formed a support frame 2; a sheet supply tray 10; a sheet supply unit 3 disposed on one side of the support frame 2 for drawing sheets stacked on the sheet supply tray 10; a transport unit 5 for receiving the sheets drawn from the sheet supply unit 3 and for transferring them to a predetermined position on a platen of an image reading apparatus (not shown) located below the sheet supply unit 3; discharge means 4 disposed on the other side of the support frame 2 for discharging the sheets after reading images; and a discharge tray 11 for stacking the discharged sheets. A switch back path 25 for reversing the sheet after reading is situated under the discharge tray. Also, a front cover 6 and a rear cover 7 are disposed to protect a main body of the apparatus. The sheet supply unit 3, the transport unit 5, and the discharge unit 4 are mounted to predetermined mounting locations on the support frame 2.

Each of the sheet supply unit 3, the discharge unit 4 and the transport unit 5 is provided with a sheet supply motor, discharge motor and transfer motor (not shown) capable of rotating in forward and reverse directions for driving rollers.

The sheet is stacked with a surface with images upward on the sheet supply tray 10, as shown in FIG. 2. The sheet supply unit 3 draws the stacked sheet. After the sheet is reversed 180 degrees, the sheet stops with the surface downward at a predetermined reading position under a transfer belt 18 of the transfer means 5. After the sheet is read, the sheet is discharged onto the discharge tray 11 by the discharge unit 4.

When the sheets stacked on the sheet supply tray 10 are a set of a plurality of sheets, a page order of the set is reversed if using the above sheet discharging method, because the sheets are drawn out and read continuously from the upper most sheet. To prevent this, the discharge unit does not discharge the sheet after reading to the discharge tray. Instead, the discharge unit first transfers the sheet into the switchback path 25 situated on a backside (an inner-side) of the discharge tray 11, then discharges the sheet into the discharge tray 11 from a trailing edge of the sheet, thereby maintaining the original page order of the set.

Operations of supply, transfer, switchback and discharge of the sheets in the sheet transfer apparatus according to the present invention will be described below, including an operation for reading both sides of the sheets.

When the sheets are transferred into the switchback path 25, a sheet jam (paper jam) can easily occur since the sheets are bent by the discharge means before the transfer inlet and the sheets move forward and backward inside the switchback path. For that reason, the switchback path must be structured to open so that an operator can easily remove the jammed paper.

FIG. 2 illustrates the first embodiment of the sheet transfer apparatus according to the present invention. According to the first embodiment, the sheet supply tray 10 is mounted to an upper portion of the apparatus, and the sheet supply unit 3 disposed at a left side supplies the sheets to the transfer unit 5 sequentially from the uppermost sheet stacked on the sheet supply tray 10. The discharge tray 11 is disposed below the sheet supply tray 10. As described above, after reading the images, the sheet must be reversed as needed. For this purpose, the switchback path 25 is established inside the discharge tray.

The discharge tray 11 is divided into two main portions. The first main portion is a first discharge tray portion 11A that opens a sheet inlet of the switchback path. The second main portion is a second discharge tray portion 11B adjacent to the first discharge tray portion 11A. The discharge tray 11 is structured to open using the first discharge tray portion 11A and second discharge tray portion 11B.

Specifically, the first discharge tray portion 11A alone rotates upward to open the switchback path, when the sheet is jammed at the sheet inlet of the switchback path. Also, the second discharge tray portion 11B rotates upward when the sheet is jammed deeper inside of the switchback path. With this structure, it is possible to open the switchback path 25 to remove the jammed sheet.

Figure 3:
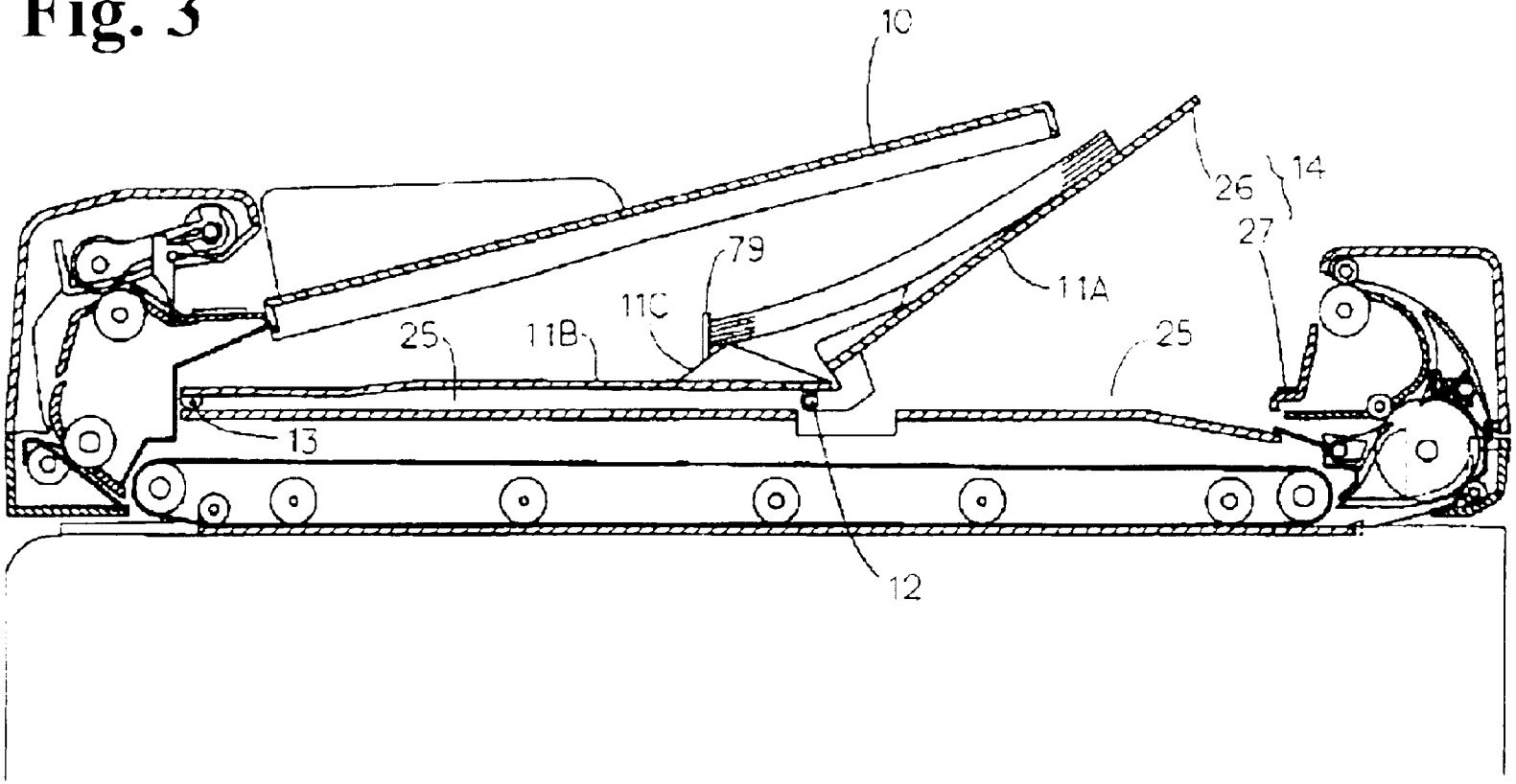
FIG. 3 is a section view of the sheet transfer apparatus of the first embodiment in a state that only the first discharge tray portion is opened while a sheet smaller than A4 size is placed on the discharge tray.

FIG. 3 shows a state in which only the first discharge tray portion 11A opens.

The first discharge tray portion 11A is hinged to the second discharge tray portion 11B in a way that the first opening portion can rotate around a shaft 12 with regard to the main frame (not shown). The second discharge tray portion 11B is hinged to the apparatus frame such that the second opening portion can rotate around a shaft 13.

As shown in FIG. 3, the first discharge tray portion 11A can rotate up to approximately 55 degrees according to this embodiment. This angle provides an enough space to remove any jammed sheets. If it is opened any further, it will hit the upper sheet supply tray 10.

Note that it is perfectly acceptable to rotate the upper sheet supply tray 10 upward around the sheet feeder side to open wider than the angle described above.

As shown in FIG. 3, the first discharge tray portion 11A may rotate upward while the sheets, for example, A4 size sheets, are stacked thereupon after reading. When the first discharge tray rotates with the sheets, like the A4 size sheets, stacked thereupon, a stopper disposed as the sheet regulating means to regulate the falling of the sheets, described in detail below, prevents the sheets from being disorganized.

Also, the second discharge tray portion 11B can rotate up to approximately 30 degrees. Normally, 25 degrees is enough because the paper jams mainly occur in the first discharge tray portion 11A, and the first opening portion can open wider. With this configuration, it is easier to handle the paper jam at the sheet inlet of the switchback path, and it is also possible to handle the paper jam at farther from the sheet inlet.

Figure 4:
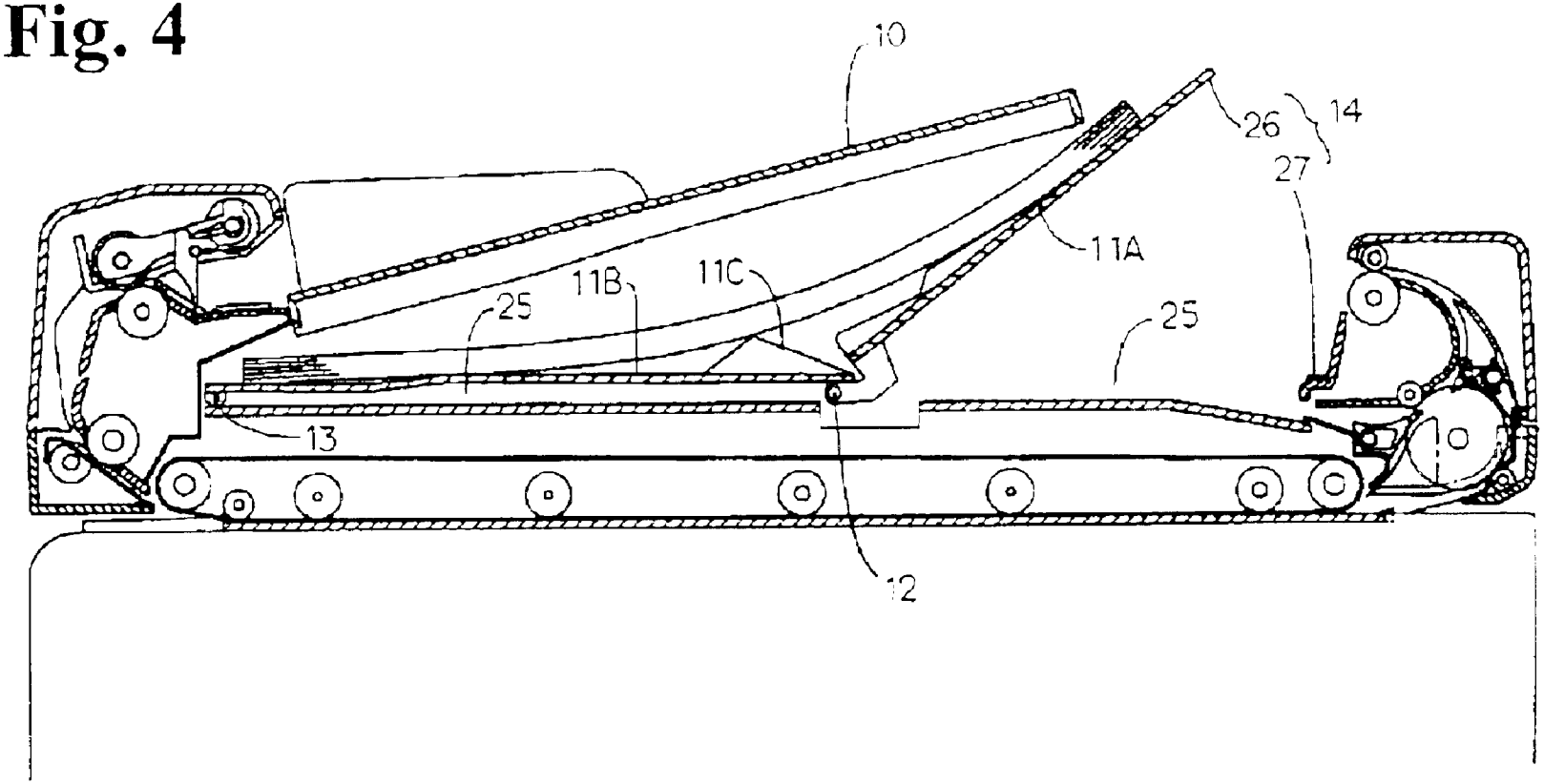
FIG. 4 is a sectional view of the sheet transfer apparatus of the first embodiment in a state that only the first discharge tray portion is opened while a sheet smaller than A4 size is placed on the discharge tray.

As seen in FIG. 4, when larger sized sheets, like A3 or B4, are placed on the discharge tray 11, the stopper 79 is positioned at a location not protruding from the tray protruding portion 11C as such a sheet slides for a shorter distance on the tray, even when the first discharge tray portion 11A is rotated upward. This is to prevent the stopper 79 from pushing upward the sheets straddling between the first discharge tray 11A and the second discharge tray 11B.

A sheet magnet is attached to a top of a free opening portion of the first discharge tray 11A. Also, a steel piece 27 is disposed on a portion corresponding to the magnet at the apparatus frame. The magnet portion 26 and the steel piece 27 attract with each other. They form opening lock means 14 of the first discharge tray 11A and the second discharge tray 11B. Although not shown in the drawings, the second discharge tray portion 11B also is provided with the same opening lock means 14. This opening lock means 14 prevents problems such that the first discharge tray portion 11A and the second discharge tray portion 11B inadvertently open when the sheet transfer apparatus 1 closes or opens the platen 31. Therefore, the first discharge tray portion 11A and the second discharge tray portion 11B open only when an operator tries to open.

The following will describe actions of the first embodiment of the present invention with reference to FIG. 5 to FIG. 9.

Figure 5:
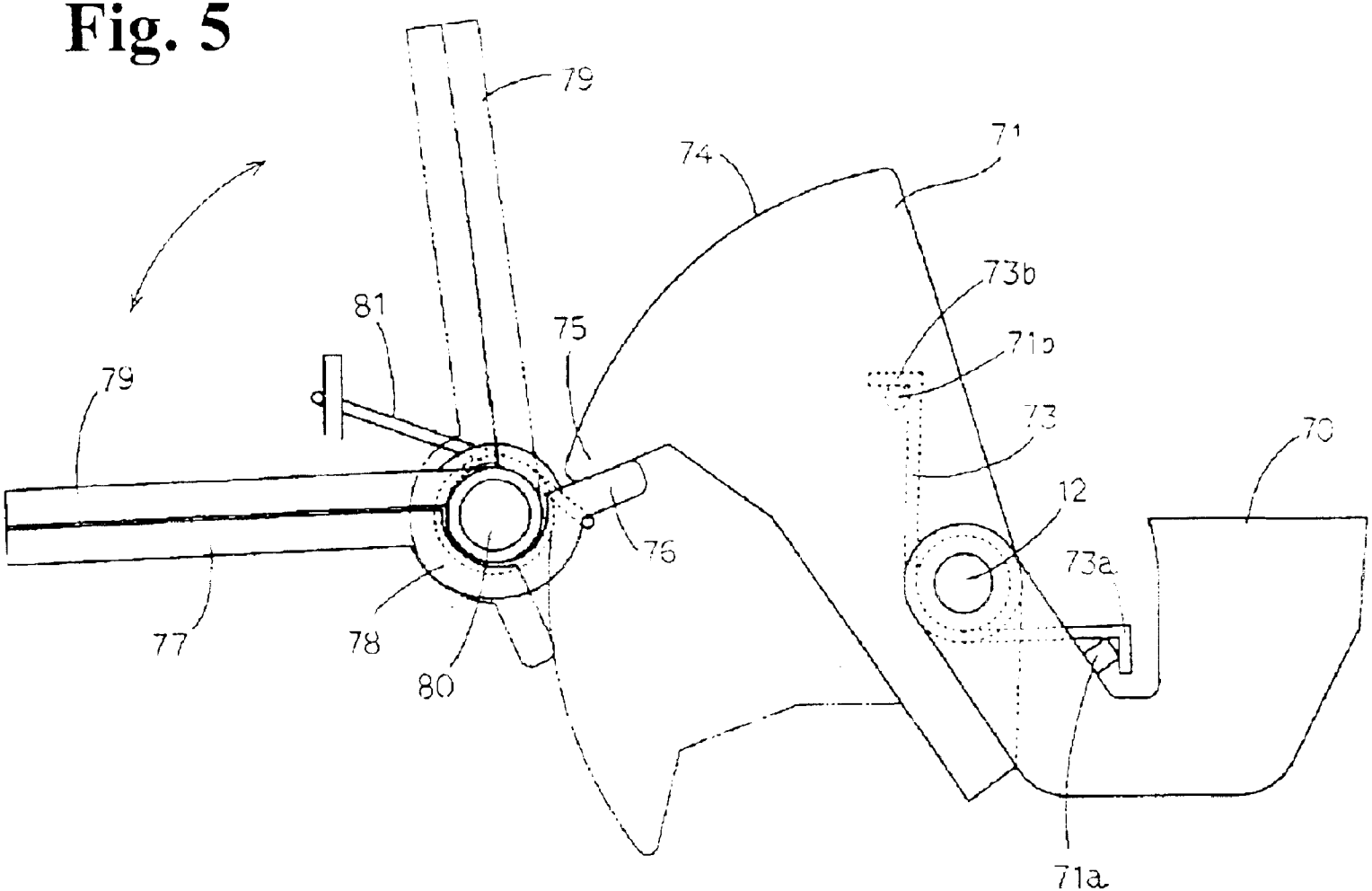
FIG. 5 is an enlarged view of sheet regulating means of the first embodiment.

FIG. 5 shows an operational mechanism of the stopper 79 as the sheet regulating means, which disappears and appears from the discharge tray 11.

The tray arm 70 is fastened to the first discharge tray portion 11A and is rotatably mounted to the tray rotating shaft 12 disposed on the main unit frame. The blade-shaped cam member 71 is rotatably mounted to the rotating frame 12. The tray arm 70 and the cam member 71 are separately joined with a coil spring 73 wrapping around a portion of the rotating shaft 12. Specifically, an end 73*a* of the coil spring is mounted to an arm pin 71*a* disposed on the tray arm 70, and the other end 73*b* is attached to a cam pin 71*b* disposed on the cam member 71. Therefore, when the first discharge tray portion 11A moves upward, the tray arm 70 also moves upward rotating around the rotating shaft 12, thereby transmitting the rotation to the cam member 71 via the coil spring 73.

The stopper shaft 80 of the stopper 79 is mounted to a portion of the second discharge tray 11B as a pivot. The stopper 79 rotates between a retracted position (solid lines of the stopper 79 in FIG. 5) that is flush with a tray surface of the second discharge tray portion 11B, and a sheet regulating posit ion (phantom lines of the stopper 79 in FIG. 5) where it stands up from the tray surface to abut against the sheets. The stopper shaft 80 mounted on the second discharge tray portion 11B comprises a cam touching portion 76 positioned at one end thereof on the cam member side, and a lever 77 positioned at the other end for receiving the stopper 79 mounted to an end of the stopper shaft 80 on the apparatus frame side. A stopper bearing means 78 for bearing the stopper shaft 80 is also disposed thereupon.

The stopper bearing means 78 is arranged to rotate on the same shaft as the stopper shaft 80, and the second coil spring 81 is disposed between the apparatus frame and the stopper bearing means 78 for constantly urging the stopper 79 toward the retracted position on the tray surface.

A leading edge of the lever touching portion 75 on the cam member 71 touches the lever cam touching portion 76. Therefore, when the cam member 71 rotates in the counterclockwise direction of the drawing, the lever touching portion 75 presses the cam touching portion 76 downward. This downward movement moves the stopper bearing means 78 to rotate clockwise around the stopper shaft 80. Accordingly, the stopper 79 also rotates around the stopper shaft 80 in the clockwise direction to stand. Note that while the cam surface 74 abuts the cam touching portion 76 through the rotation of the cam member 71, the stopper will not move in the counterclockwise direction to be in the retracted position even if a load is applied to the leading edge of the stopper 79 in the counterclockwise direction.

As described above, a configuration interconnecting the tray arm 70 to the stopper 79 constitutes the interconnecting means 70 and 78 and the sheet regulating means 79.

As shown in FIG. 4, when the sheets are stacked on the stopper 79, a rotational load is applied to the leading edge thereof, even if the first discharge tray portion 11A is rotated. This load on both the tray arm 70 and the cam member 71 is stronger than the force of the spring that connects both, so even if the first discharge tray portion 11A is rotated, the coil spring simply bends without moving the cam member. Accordingly, the stopper does not move to cause any unnecessary movements such as lifting up the sheets.

An upward rotating movement of the first discharge tray portion 11A and a rising action of the stopper 79 through the upward movement will be explained with reference to FIGS. 6(*a*)–6(*c*) and FIGS. 7(*a*)–7(*c*). Note that a size of the sheets placed on the tray is A4, but the sheets are omitted from the drawings for explanation.

Figures 6A, 6B, 6C:
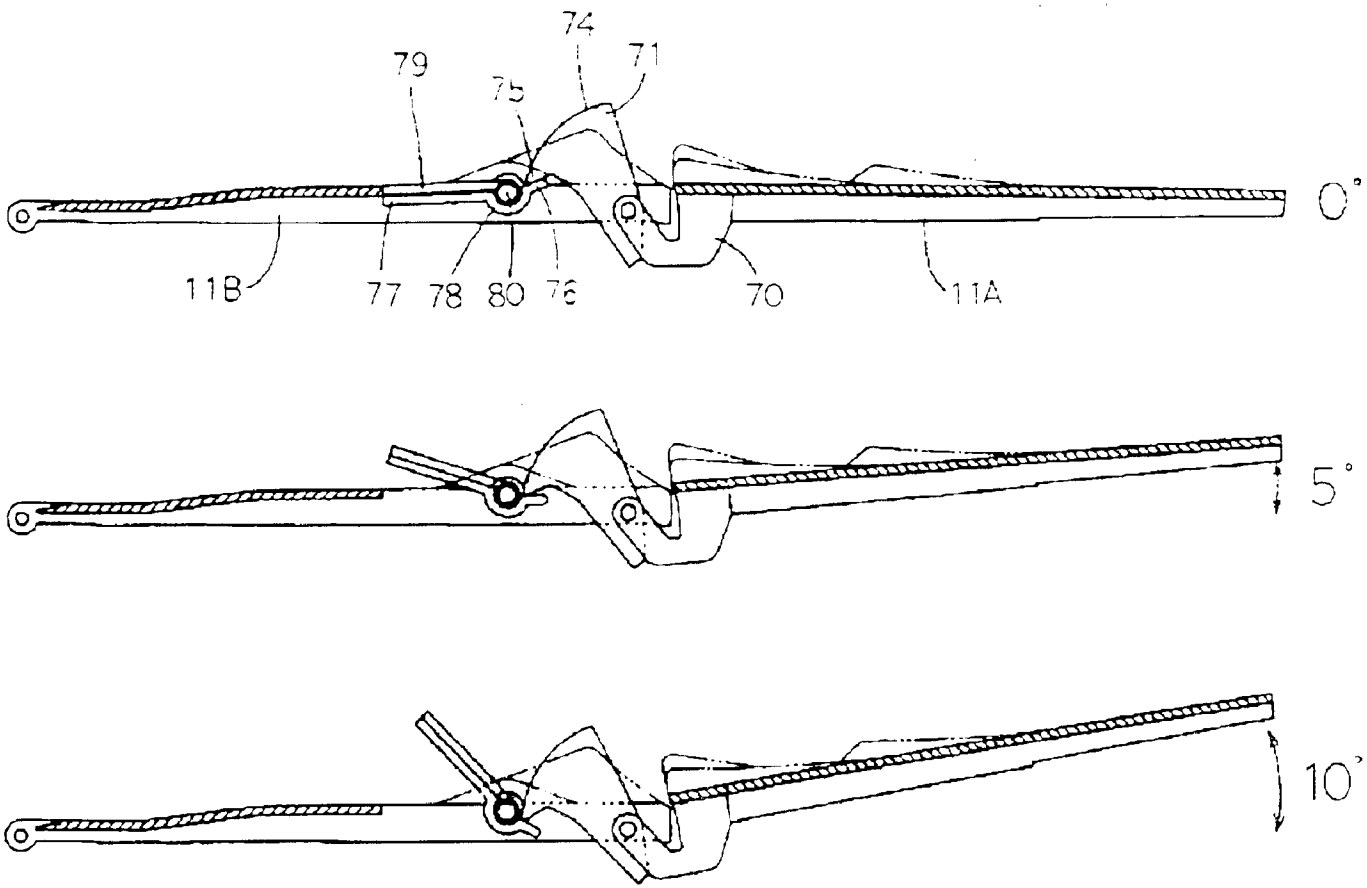
FIGS. 6(*a*)–6(*c*) are views showing a discharge tray portion of the first embodiment in a state that the sheet regulating means (stopper) rotates along with the first discharge tray.

First, FIG. 6(A) shows a state that a discharged sheet is received on the discharge trays 11A and B. In this state, the first discharge tray portion 11A is substantially horizontal, namely 0 degree in this embodiment. In this state, the stopper 79 disposed on the second discharge tray portion 11B at a location near the first discharge tray portion 11A is in a retracted state flush with the second discharge tray portion 11B. Note that even in this state, the cam touching portion 76 positioned at the other side of the lever 77 that moves the stopper 79 is constantly urged toward the lever touching portion 75 of the cam member 71 by the lever spring 81.

Figures 7A, 7B, 7C:
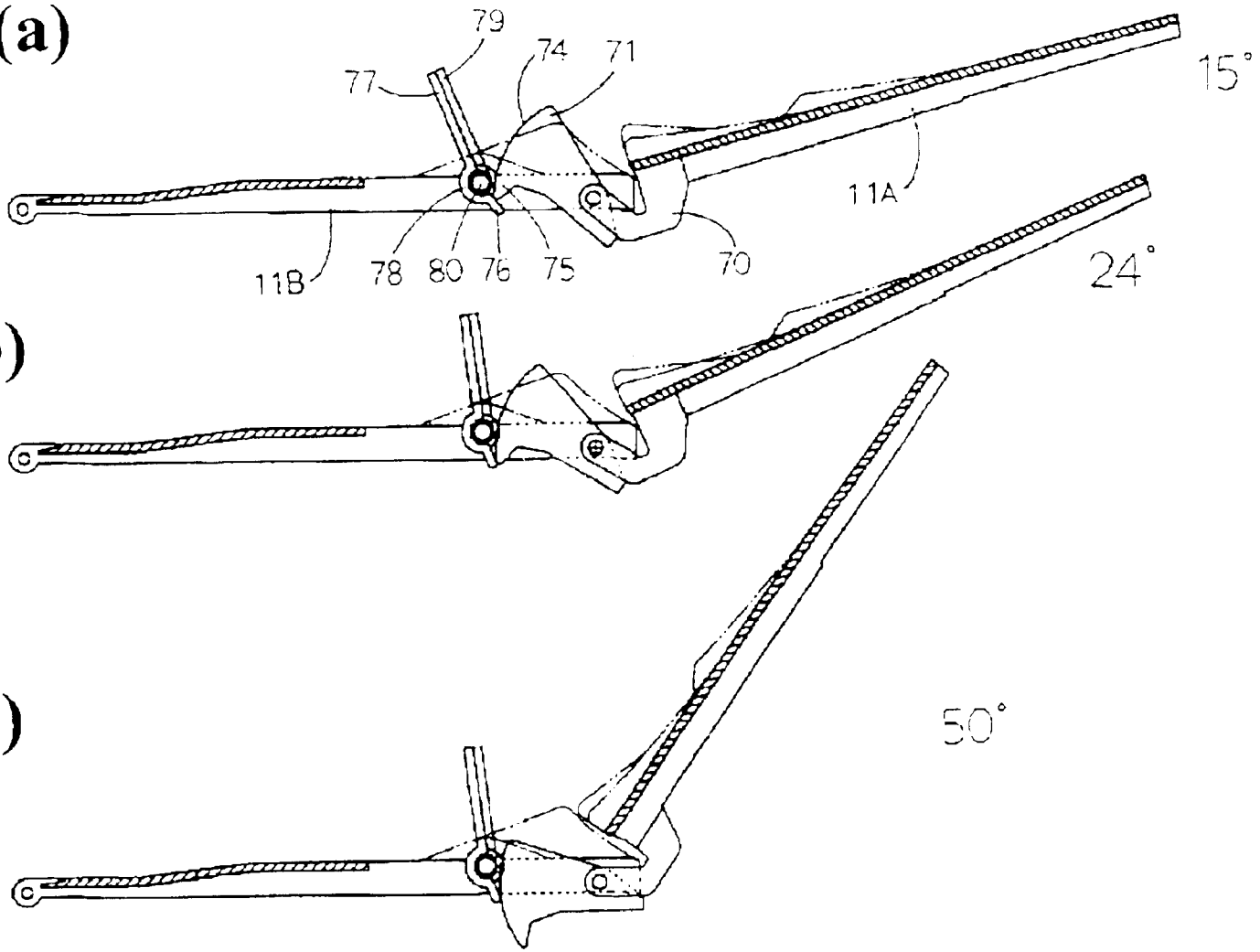
FIGS. 7(*a*)–7(*c*) are views showing a discharge tray portion of the first embodiment in a state that the sheet regulating means (stopper) rotates along with the first discharge tray.

The drawings from FIG. 6(*b*) to FIG. 7(*a*) show a state that the first discharge tray portion 11A rotates from approximately 5 degrees to 24 degrees. This rotational movement rotates the cam member 71 and moves the lever touching portion 75 of the cam member, thereby moving the stopper member to the standing position.

It is confirmed that the sheets on the first discharge tray portion 11A slide downward when the rotational angle becomes larger than 25 degrees. Therefore, when the cam touching portion 76 touches the cam surface 74 of the cam member 71 from a point beyond 24 degrees, as shown in FIG. 7(*a*), the stopper 79 is locked. Therefore, even if the sheets fall against the stopper 79, the stopper 79 does not retract to overlap the second discharge tray portion 11B.

FIG. 7(*b*) shows a state that the first discharge tray portion 11A opens completely. In this embodiment, the first discharge tray portion opens 55 degrees from the horizontal position. In this state, the switchback path 25 is completely opened, thereby making it easy to remove the paper jam.

When the paper jam is removed, the first discharge tray portion 11A is closed in the order of FIGS. 7(*c*) to 7(*b*) to 7(*a*) to FIGS. 6(*c*) to 6(*b*) to 6(*a*). In this case, when the first discharge tray portion 11A is closed to the angle below 25 degrees where the sheets do not fall, the cam surface 74 is away from the cam touching portion 76 of the stopper bearing means 78 so the sheets do not slip out of place.

Figure 8:
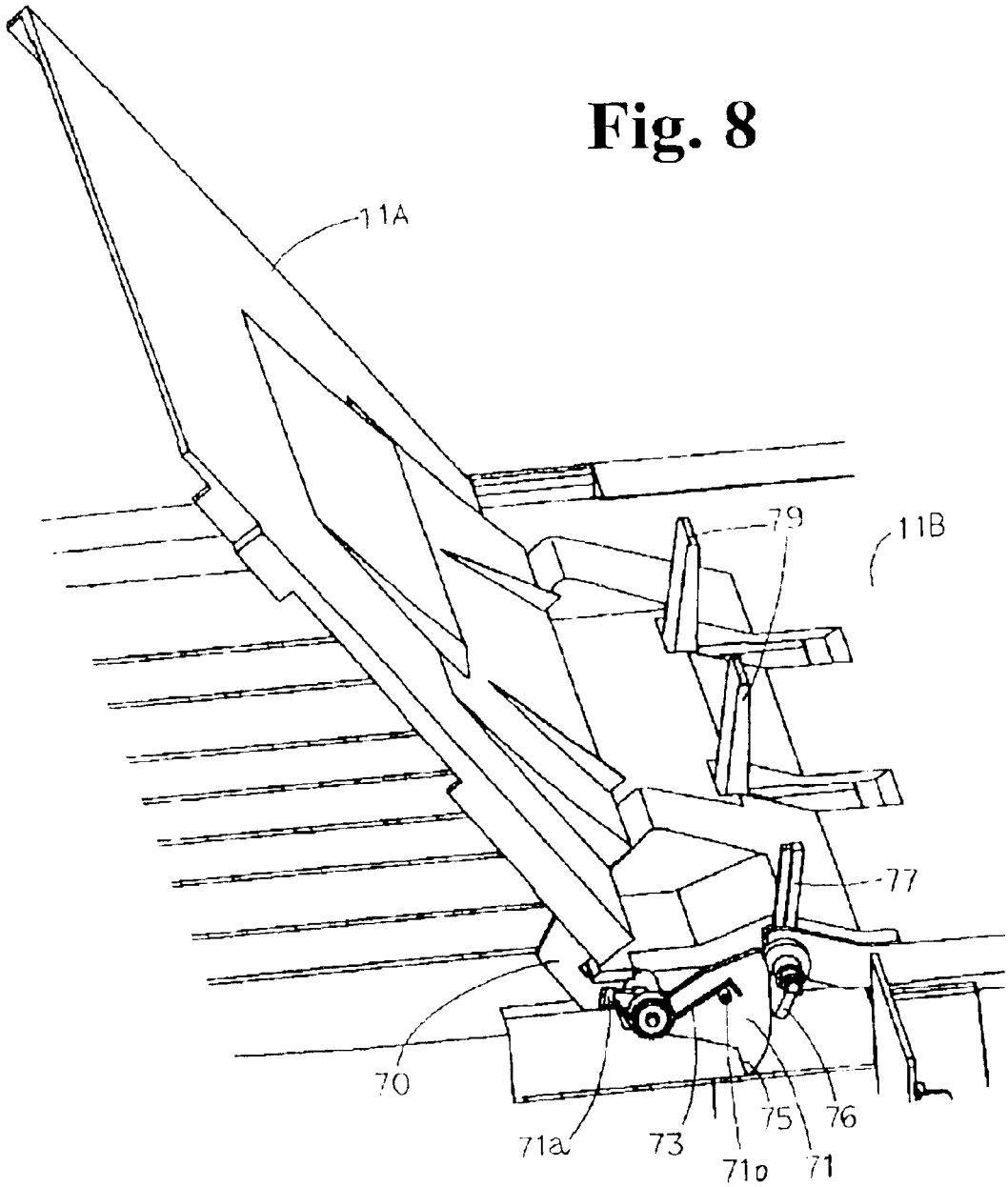
FIG. 8 is a perspective view of the sheet transfer apparatus of the first embodiment in a state that the first discharge tray rotates.

FIG. 8 is a perspective view of the first discharge tray portion 11A shown FIGS. 7(*a*)–7(*c*) in a state that the tray portion opens from the horizontal state to 55 degrees. As shown in FIG. 8, when there are no sheet on the stopper 79 (specifically, no sheet straddling between the first discharge tray portion 11A and the second discharge tray portion 11B), the sheet regulating means (stopper) 79 stands at the sheet regulating position to control the movement of the sheets through the interconnecting mechanism formed of the interconnecting means 70 to 78. With this configuration, even though an operator opens the first discharge tray portion 11A, which is a portion of the discharge tray 11, to remove the paper jam when the paper jam occurs in the switchback path 25 (in FIG. 1) formed below the discharge tray 11, the sheets such as A4 size sheets discharged to the first discharge tray portion 11A are prevented from moving toward the second discharge tray portion 11B, thereby preventing the discharged sheets from being disorganized.

Figure 9:
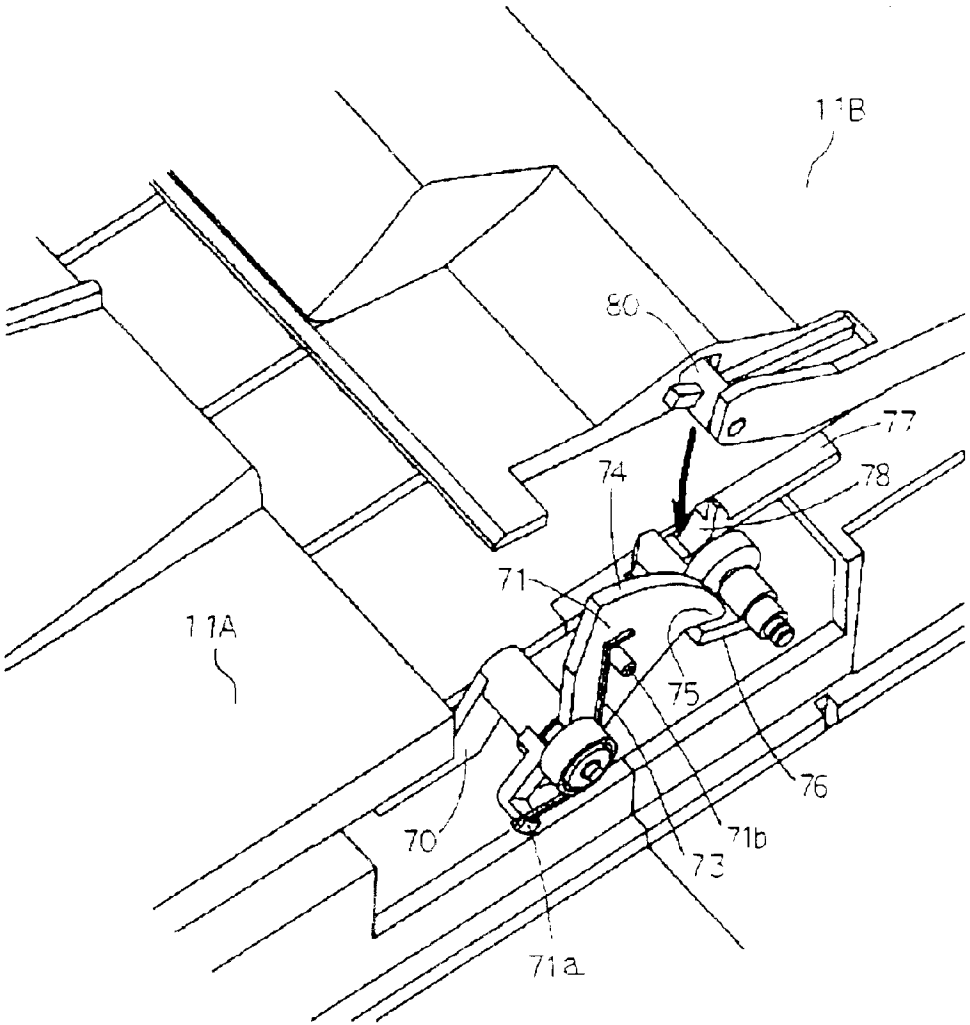
FIG. 9 is a perspective view showing the discharge tray portion of the first embodiment in a state that the second discharge tray is opened upward.

FIG. 9 is a perspective view of a state that the stopper 79 having the stopper shaft 80 is separated from the stopper bearing 78. In this state, the second discharge tray portion 11B rotates upward. Thus, in the sheet transfer apparatus, the second discharge tray portion 11B can be rotated upward to open. Thus, if the paper jam occurs in the switchback path 25 (FIG. 1) formed below the discharge tray 11, and the jammed sheet reaches all the way below the second discharge tray portion 11B, the operator can easily remove the jammed sheet from the switchback path with a simple operation.

Figure 10:
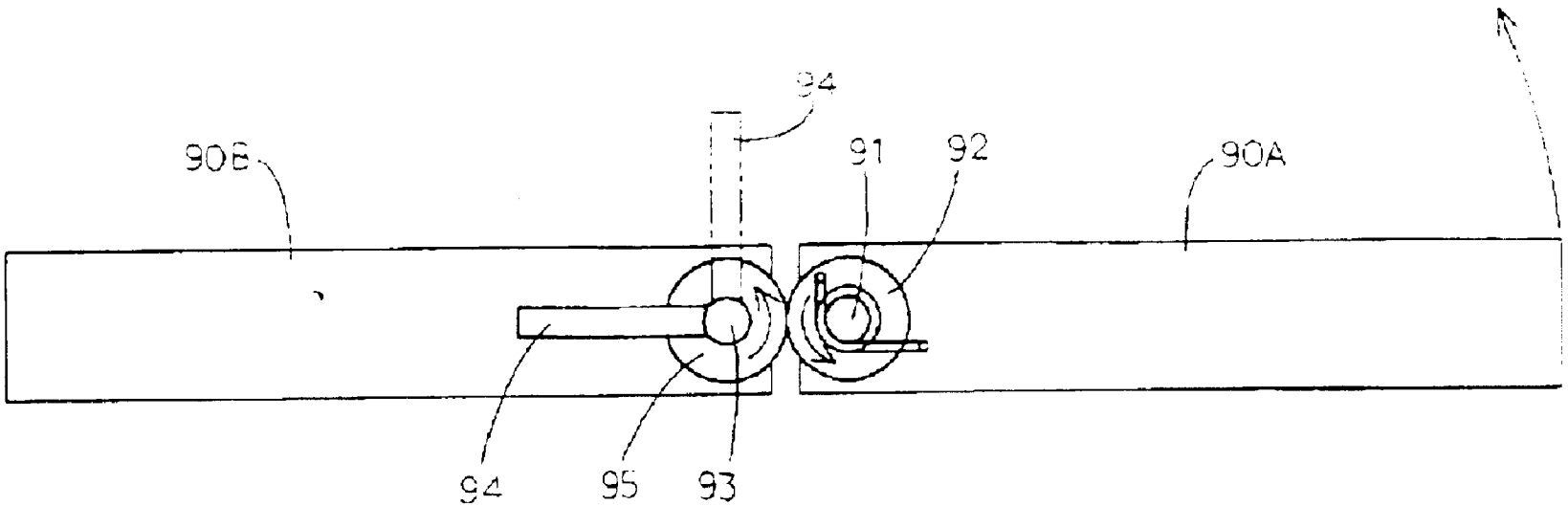
FIG. 10 is a view showing a discharge tray of the second embodiment of the present invention.

FIG. 10 shows the second embodiment of the present invention. Here, as the interconnecting means 12, a friction roller is used instead of the cam means. Specifically, a rubber roller 92 comprising a specific coefficient of friction is mounted to a shaft 91 that rotates along with the first discharge tray 90A. A rubber roller 95 is mounted to a rotating shaft 93 of the stopper 94 for rotating along with the stopper.

Therefore, when an operator rotates the first discharge tray portion 90A upward, the rubber roller 92 rotates in the counterclockwise direction in the drawing. The rubber roller 95 rotates in the clockwise direction due to rotational friction, thereby moving the stopper 94 in the standing direction.

When the sheet is positioned over the stopper 94 and a rotational load is applied thereto, the rubber rollers 92 and 95 slip with each other, thereby leaving the stopper 94 at a position overlapping the second discharge tray portion 90B.

Figure 11:
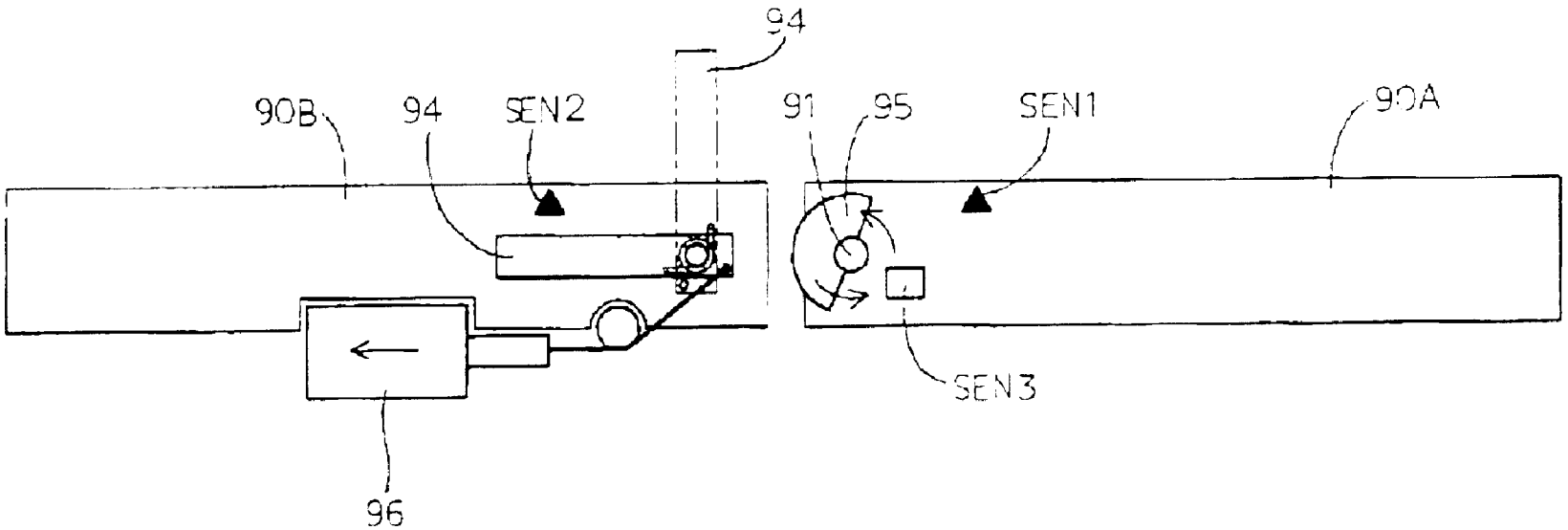
FIG. 11 is a view showing a discharge tray of the third embodiment of the present invention.

FIG. 11 shows the third embodiment of the present invention. An apparatus is provided with a sheet sensor for detecting the sheets on the discharge tray and a tray position sensor for detecting the rotation of the first discharge tray. The apparatus further includes drive means such as, for example, a solenoid, for moving the stopper according to a detection result of the sensors.

That is, a sensor SEN1 is disposed on the first discharge tray portion 90A for detecting whether the sheets are placed on the tray. The first discharge tray portion 90A is fastened to the rotating shaft 91. The rotating shaft 91 is rotatably mounted to the apparatus frames, which is not shown in the drawings. A semi-circular detection flag 95 is disposed on the rotating shaft 91. When the first discharge tray portion 90A is rotated upward (in the counterclockwise direction), the detection flag 95 also rotates in the counterclockwise direction. An angle sensor SEN 3 detects a position of the detection flag 95.

In the second discharge tray portion 90B, a stopper 94 is rotatably mounted to the stopper rotating shaft 93 in the second discharge tray portion 90B, and a solenoid 96 is attached to the stopper 94 by a wire and the like. A second sheet sensor SEN 2 is disposed at downstream of a rotating shaft of the stopper 94 in the sheet discharge direction for detecting whether the sheets are placed on the second discharge tray portion 90B. A spring is disposed at a side opposite to an attracting direction of the solenoid 96 for pulling the stopper 94 in the closing direction.

Figures 12, 13:
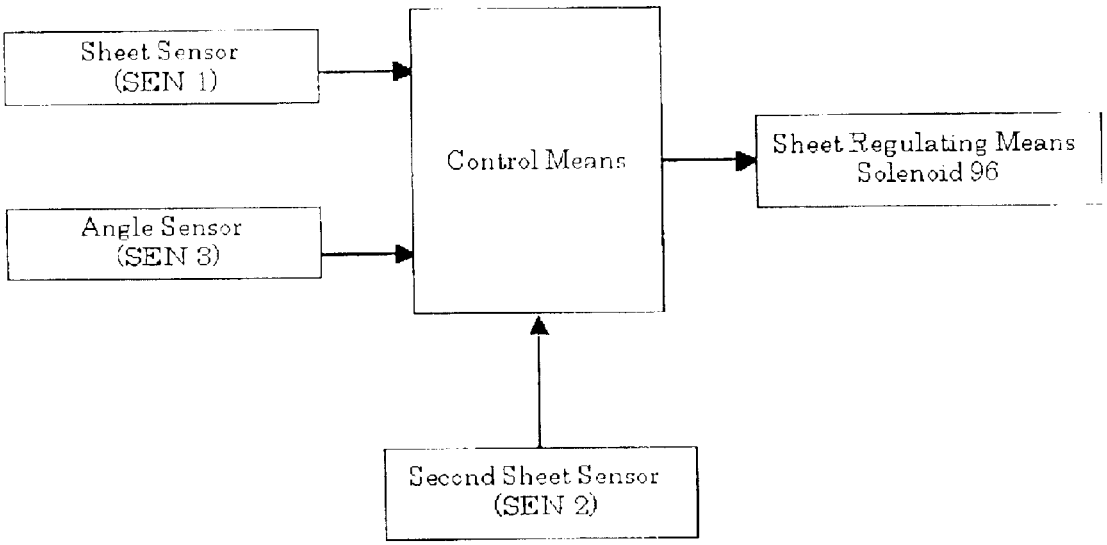
FIG. 12 is a view showing a control block for controlling drive of a stopper in the third embodiment.
FIG. 13 shows detection results of sensors in the control block in FIG. 12.

FIG. 12 shows a block diagram for controlling the solenoid 96 as the drive means to move the stopper 94 according to the detection signals from the sheet sensor SEN 1, the second sheet sensor SEN 2, and the angle sensor SEN 3.

As shown in FIG. 13, in the control means, the sheet sensor SEN 1 detects the sheet on the first discharge tray portion 90A (SEN 1 is ON), and when the second sheet sensor does not detect anything (SEN 2 is OFF), it is determined that a small-sized sheet is placed. In this case, when the angle sensor SEN 3 detects (SEN 3 is ON), it is determined that the first discharge tray portion 90A is opened upward, and the solenoid 96 is activated to stand the stopper 94.

When the sheet sensor SEN 1 detects the sheet (SEN 1 is ON) and the second sheet sensor SEN 2 also detects the sheet (SEN 2 is ON), it is determined that a large-sized sheet is placed on the first discharge tray portion 90A. In this case, it is unnecessary to stand the stopper 94, so even if the angle sensor SEN 3 detects (SEN 3 is ON), the solenoid 96 is not activated. Therefore, when the sheet is placed on the stopper 94, the stopper 94 will not stand.

Figure 14:
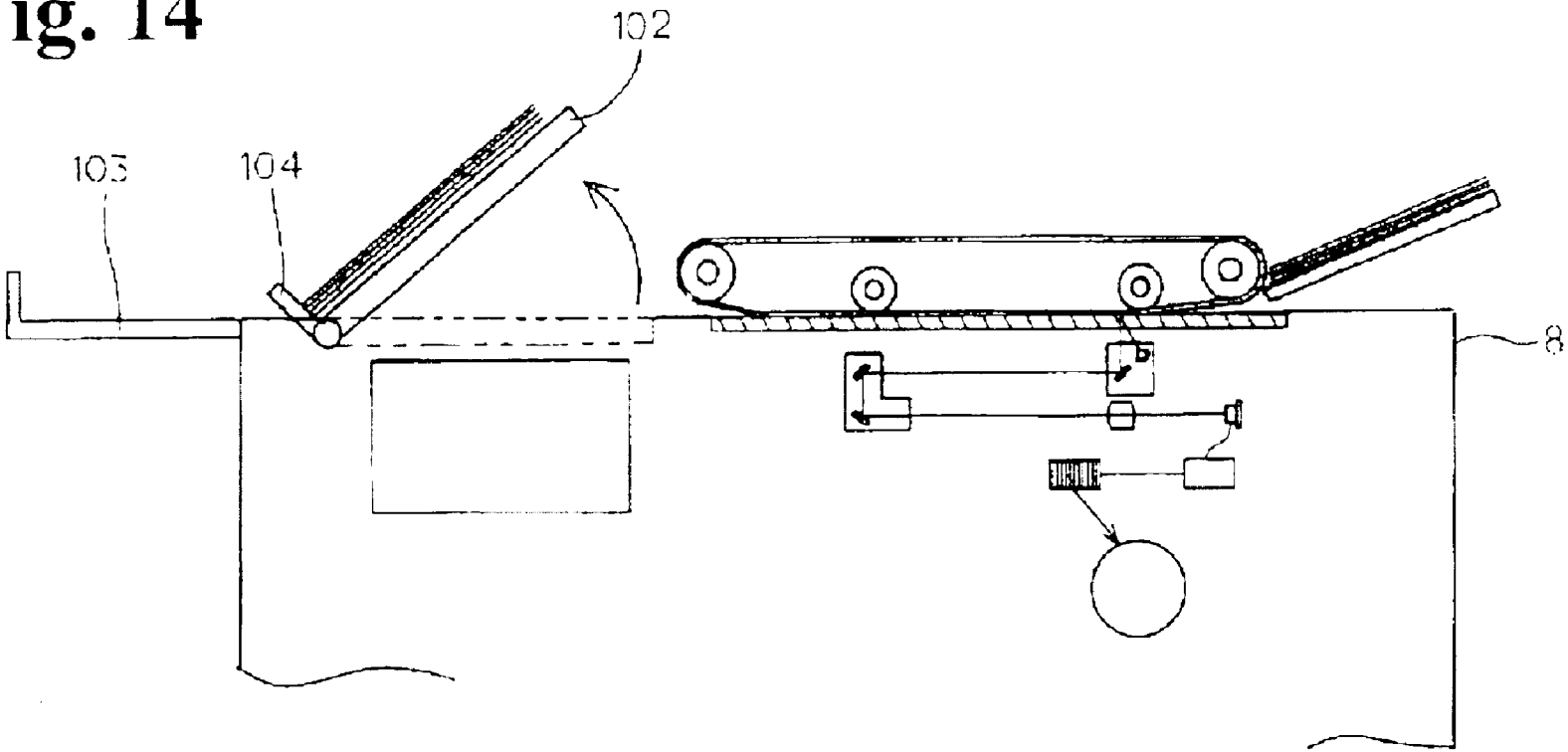
FIG. 14 is a view showing a case that an opening portion of the discharge tray is disposed in a different position.

FIG. 14 shows an embodiment in which the discharge tray opens and closes at a location different from the previous embodiments. In the previous embodiments, the operator opens the discharge tray to remove the paper jam in the switchback path 25 on the sheet transfer apparatus. In the embodiment shown in FIG. 14, an upper cover of the image forming apparatus 8 is used as the discharge tray of the sheet transfer apparatus. A toner portion is arranged below the discharge tray, and the discharge tray rotates to expose the toner portion.

It is configured that the stopper 104 stands when the first discharge tray portion 102 opens. When the large-sized sheet, is used, the second discharge tray portion 103 is also used for placing the sheets. Therefore, when the sheets are placed only on the first discharge tray portion 102 and the first discharge tray portion 102 opens upward, the sheets do not slide down and is not disordered.

Next, an overall operation of the sheet transfer apparatus from supplying to discharging the sheet will be explained.

First, a single side reading mode of the image reading apparatus will be explained with reference to FIGS. 15(*a*)–15(*c*) to FIGS. 17(*a*)–(*d*).

Figure 15A:
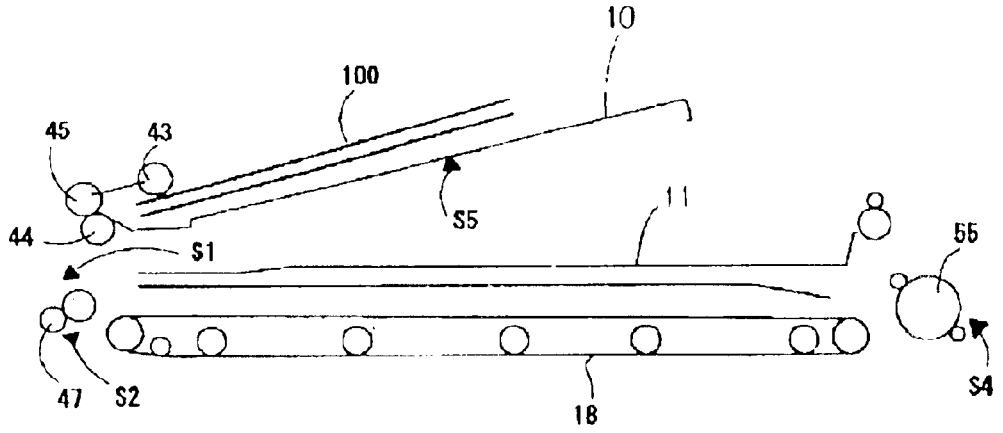
FIGS. 15(*a*)–15(*c*) are views showing an operation of reading an image on one side of an original in the sheet transfer apparatus.
Figure 15B:
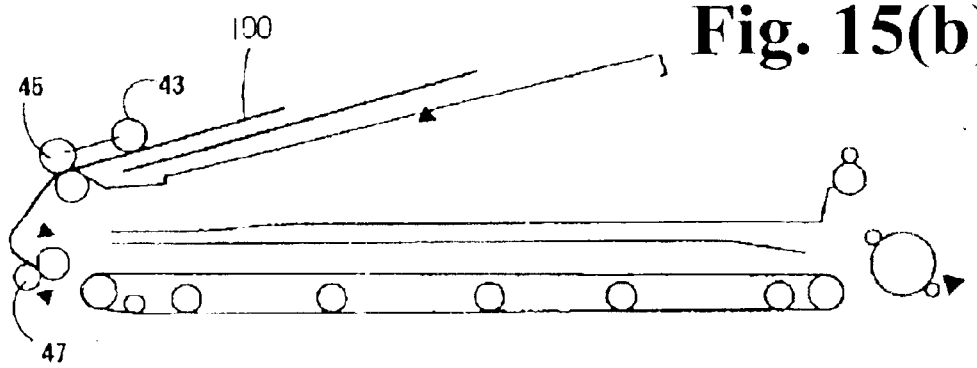
Figure 15C:
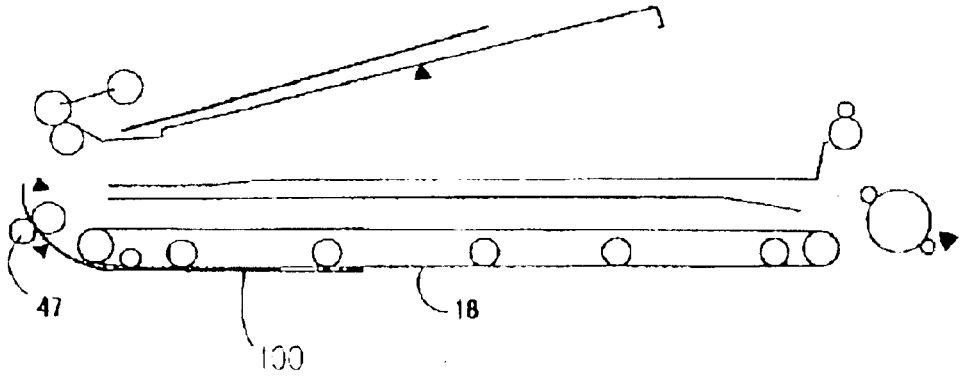

When the sheets 100 are placed on a sheet supply tray 10 (FIG. 15(*a*)) and an empty sensor S5 detects the sheets 100, a sheet supply motor (not shown) rotates forward to drive a draw-out roller 43 and a sheet supply roller 45. The sheets 100 are drawn out by the draw-out roller 43 and separated into a single sheet by the sheet supply roller 45 and a separating member 44, thereby supplying a single sheet. After a register sensor S1 detects a leading edge of the single sheet 100, the sheet supply motor M1 drives by a predetermined amount for moving the leading edge of the sheet 100 to a nip of a register roller 47 to correct skew of the sheet, then the sheet supply motor M1 stops (FIG. 15(*b*)).

The sheet supply motor rotates in reverse to rotate the register roller 47 for supplying the sheet toward the platen 31. At the same time, a transfer motor rotates forward to rotate the transfer belt 18 for transferring the sheet 100 fed by the register roller 47 along the platen 31 (FIG. 15(*c*)). After a timing sensor S2 detects the trailing edge of the single sheet 100, the sheet is transferred by a predetermined distance, and the sheet supply motor and the transfer motor stop to stop the register roller 47 and the transfer belt 18. The sheet 100 is placed at a predetermined position on an upper surface of the platen 31 where the reading means reads the sheet 100 (FIG. 16(*a*)).

At this point, while the first sheet 100 is read, if the empty sensor S5 detects the second sheet 101 on the sheet supply tray 10, the sheet supply motor rotates forward to drive the draw-out roller 43 and the sheet supply roller 45 to draw out the second sheet 101 in the same way as the first sheet 100.

Figure 16A:
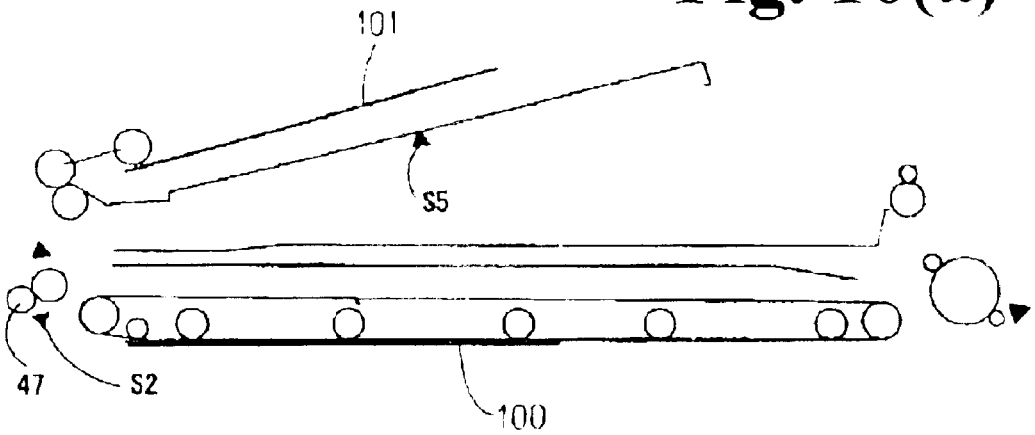
FIGS. 16(*a*)–16(*c*) are views showing an operation of reading an image on one side of an original in the sheet transfer apparatus.
Figure 16B:
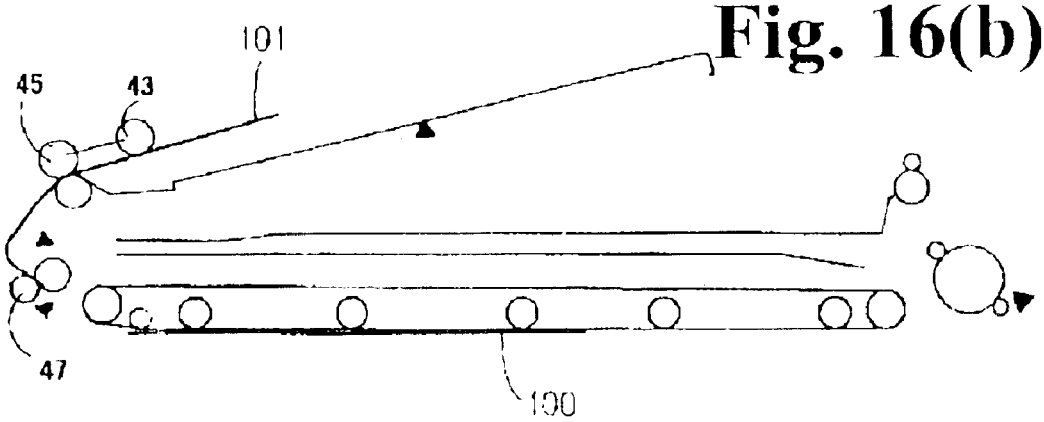
Figure 16C:
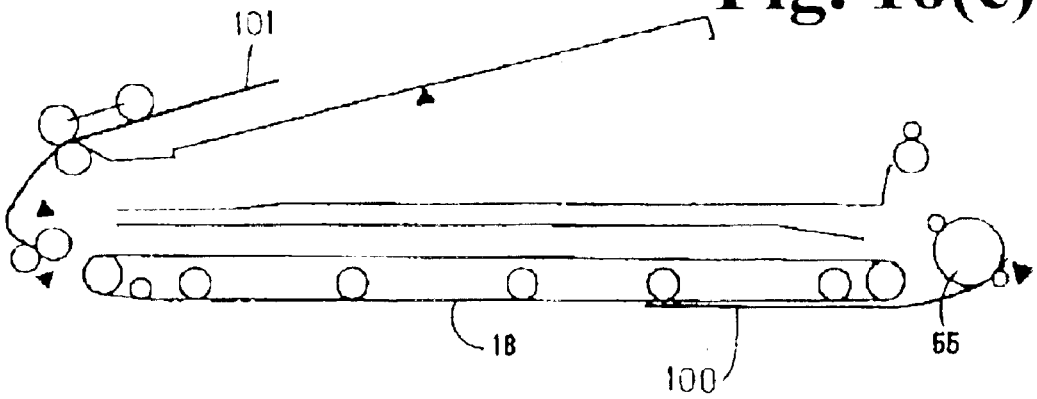
Figure 17A:
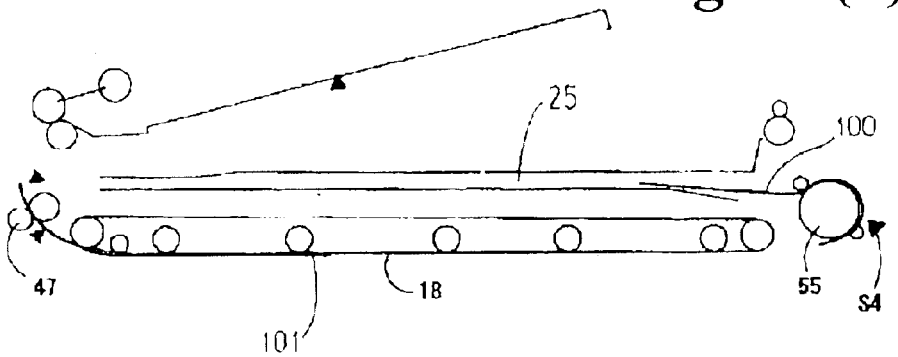
FIGS. 17(*a*)–17(*d*) are views showing an operation of reading an image on one side of an original in the sheet transfer apparatus.
Figure 17B:
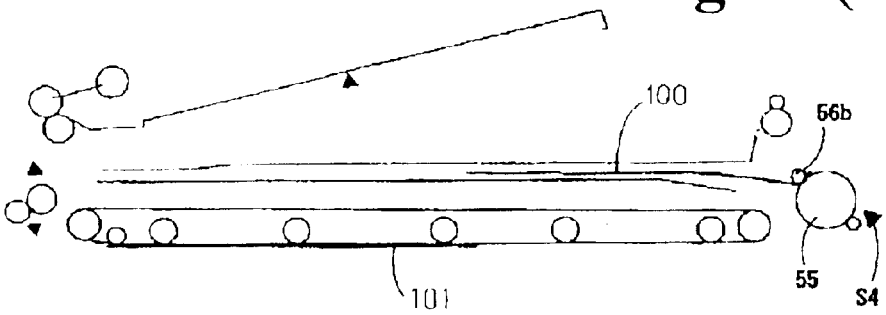
Figure 17C:
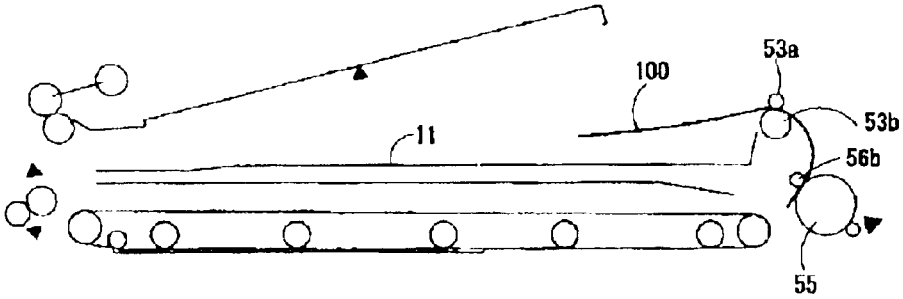
Figure 17D:
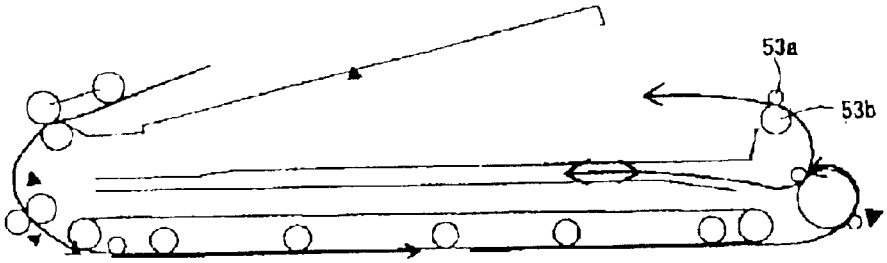

The second sheet is separated into a single sheet, and after a leading edge of the second sheet touches the nip of the register roller 47, the second sheet stops and stays there (FIG. 16(*b*)).

Upon reading the first sheet, the transport motor rotates forward again, and at the same time, a discharge motor also rotates forward. The transfer belt 18 and the inversion roller 55 rotate forward for transferring the first sheet 100 out from the top of the platen 31 (FIG. 16(*c*)).

Here, when a reverse sensor S4 detects the leading edge of the first sheet, the sheet supply motor rotates in reverse to drive the register roller 47. The second sheet 101 at the nipping point of the register roller 47 is transferred to the platen 31. In the same way as the first sheet 100, the second sheet is transferred to the predetermined position on the platen 31 and stops there.

A discharge flapper 54 and a reverse flapper 57 guide the first sheet 100 discharged from the platen 31 to the switchback path 25 (FIG. 17(*a*)). The sheet 100 is transferred by a predetermined distance after a discharge sensor S4 detects the trailing edge thereof. Then, the discharge motor stops to stop the reverse roller 55 temporarily. At this time, the trailing edge of the sheet 100 is nipped by the reverse roller 55 and a pinch roller 56*b* and the sheet is stopped at a position passing a free-falling flapper 60 (FIG. 17(*b*)). The discharge motor rotates in reverse to switchback the sheet 100 nipped and stopped by the reverse roller 55 and the pinch roller 56*b*. A pair of discharge rollers 53*a* and 53*b* discharges the sheet to the discharge tray 11 (FIG. 17(*c*)).

The same procedure of discharging as the first sheet 10 is performed for the second sheet 101. Similarly, the same process for feeding and discharging is repeated for the other sheets on the sheet supply tray 10 (FIG. 17(*d*)).

Note that there is a free-falling flapper 60 hanging downward by its own weight, and is configured to rotate upward when the leading edge of the sheet pushes the flapper as the sheet passes therethrough. Also, the discharge roller 53*b* has a drive mechanism to rotate only in one direction, regardless of the rotation of the discharge motor M2.

An operation of reading both sides of the sheet in the sheet transfer apparatus will be explained with reference to FIGS. 18(*a*)–18(*c*) to 20(*a*)–20(*b*).

Processes of supplying and transferring the sheet are the same as those in the single side reading mode. (FIG. 15(*a*) to FIG. 16(*a*))

Figure 18A:
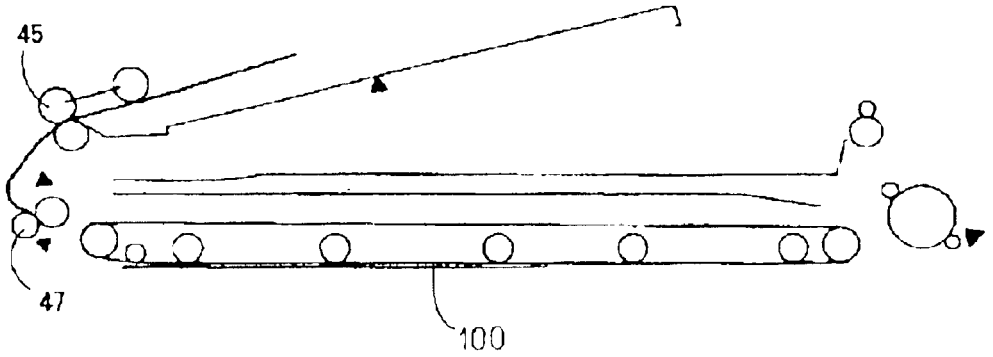
FIGS. 18(*a*)–18(*c*) are views showing an operation of reading an image on both sides of an original in the sheet transfer apparatus.
Figure 18B:
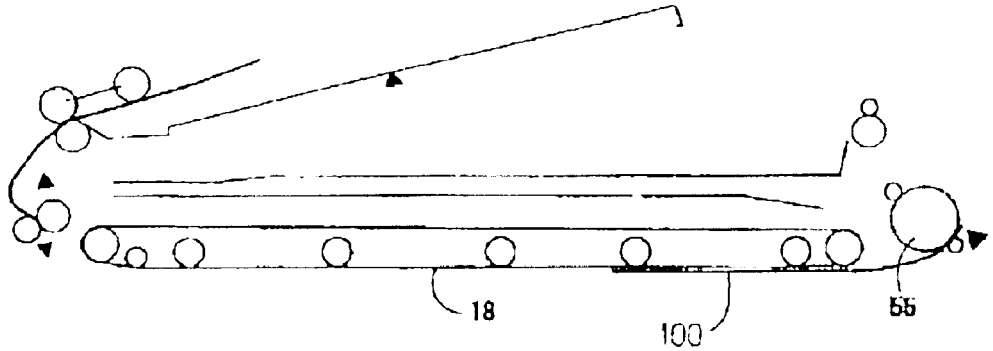
Figure 18C:
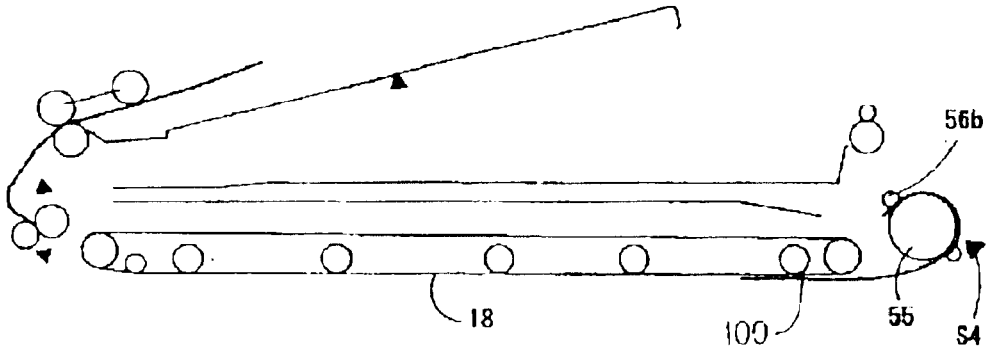

In a state shown in FIG. 18(*a*), after reading the front side, the first sheet 100 is discharged from the platen 31 (FIG. 18(*b*)) by the transfer belt 18 and the reverse roller 55 through the forward drive of the transfer motor and the discharge motor.

Figure 19A:
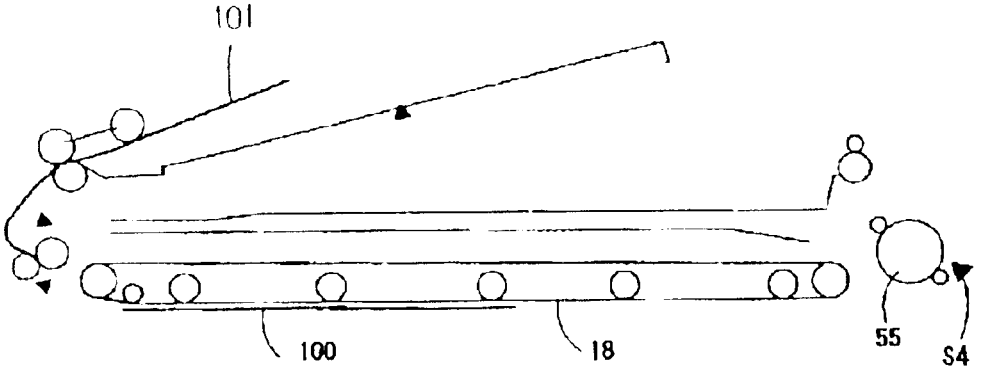
FIGS. 19(*a*)–19(*c*) are views showing an operation of reading an image on both sides of an original in the sheet transfer apparatus.
Figure 19B:
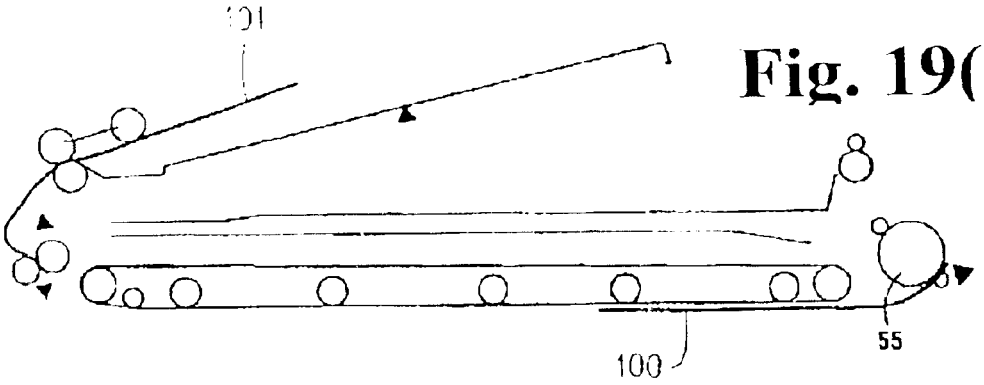
Figure 19C:
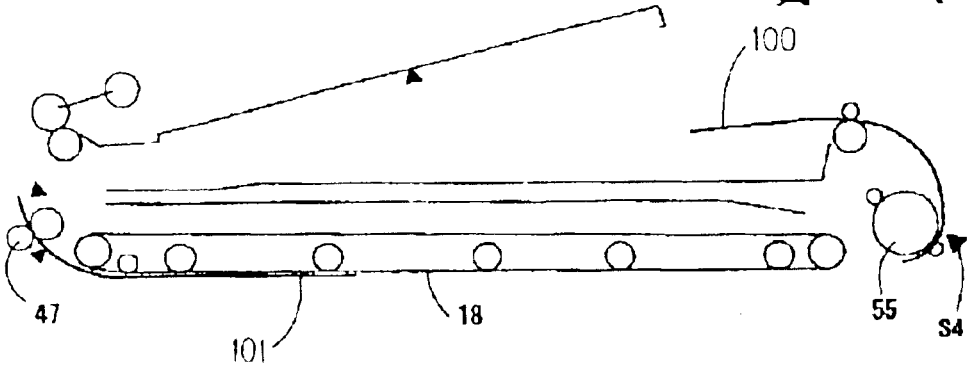

After the reverse sensor S4 detects the leading edge of the sheet 100 discharged from the platen 31, the sheet 100 passes through the discharge flapper 54 and the free-falling flapper 60. The sheet stops at a position where the reverse roller 55 and the pinch roller 56*b* nip the leading edge of the sheet, and the transfer motor and the discharge motor stop temporarily (FIG. 18(*c*)). The transfer motor rotates in reverse at the same time when the reverse flapper 57 switches to a direction to guide the sheet 100 toward the platen 31 again, and the discharge motor rotates in forward. Through these steps, the sheet 100 is reversed and fed to the platen 31 again, and is transferred to a predetermined position on the platen 31 (FIG. 19(*a*)).

The reading means reads the backside of the sheet 100 transferred to a predetermined position on the platen 31. When the reading is completed, the transport motor drives in forward and the discharge motor M2 rotates forward at the same time. The transfer belt 18 moves forward and the reverse roller 55 rotates forward for transferring the first sheet 100 from the platen 31. (FIG. 19(*b*))

When the reverse sensor S4 detects the leading edge of the first sheet 100, the sheet supply motor rotates in reverse to drive the register roller 47. The second sheet 101, which is nipped and stays at the nipping point of the register roller 47, is fed toward the platen 31. In the same way as the first sheet 100, the sheet is transferred to the predetermined position on the platen 31 and stopped there.

Figure 20A:
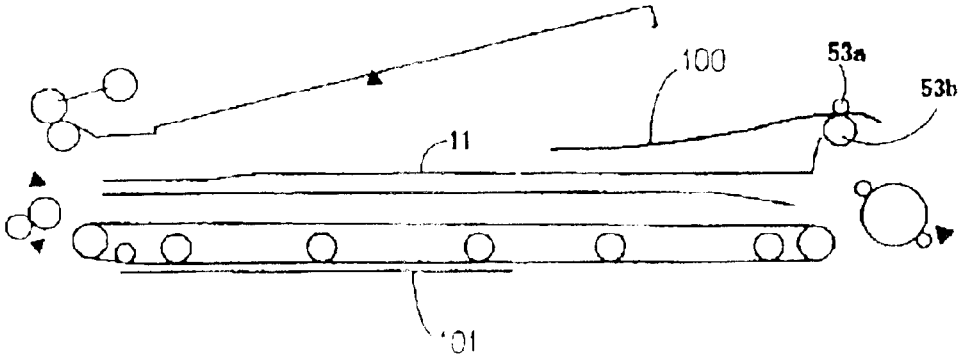
FIGS. 20(*a*) and 20(*b*) are views showing an operation of reading an image on both sides of an original in the sheet transfer apparatus.
Figure 20B:
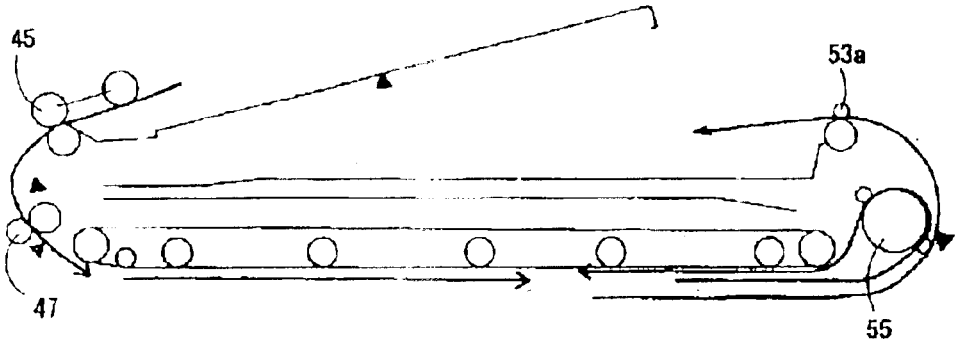
Figure 21:
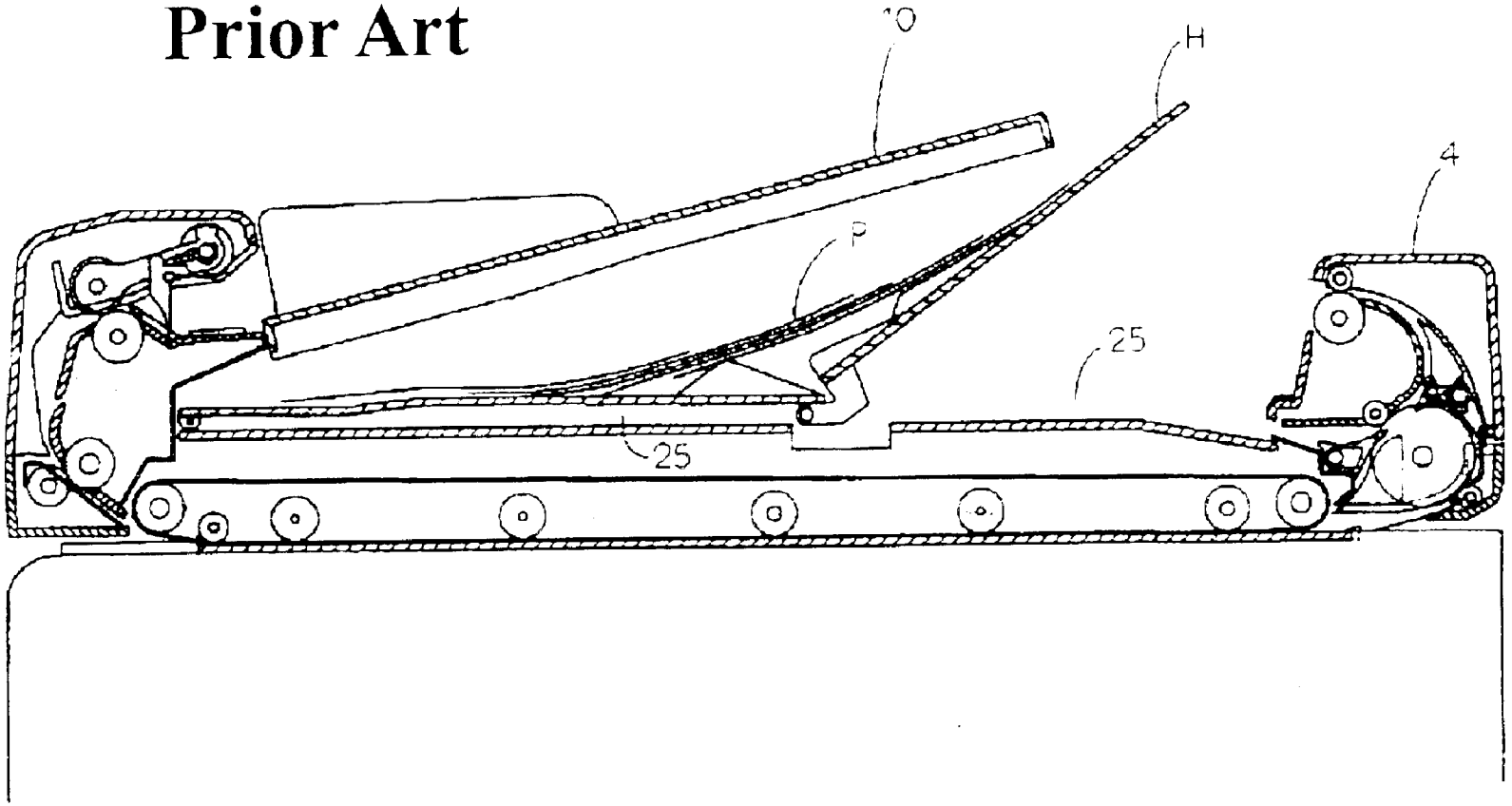
Fig. 21 Prior Art
FIG. 21 is a view showing an example of a conventional sheet transfer apparatus.

When the reverse sensor S4 detects the leading edge of the first sheet 100 discharged from the platen 31, the discharge flapper 54 switches to a position to guide the sheet 100 directly into the pair of the discharge rollers 53. A pair of discharge rollers 53*a* and 53*b* discharges the first sheet 100 to the discharge tray 11. (FIG. 19(*c*) and FIG. 20(*a*))

After that, the same procedure as the first sheet 10 is performed to discharge the second sheet 101. Similarly, the same process of feeding and discharging is repeated for other sheets on the sheet supply tray 10 (FIG. 20(*b*)).

As describe above, in the present invention, the sheet transfer apparatus is provided with the discharge tray. The sheet transfer apparatus comprises support means for supporting the discharge tray to be rotatable; interconnecting means for activating with the rotation of the discharge tray; sheet regulating means engaging or abutting the interconnecting means and being movable between the regulating position for regulating the movement of the sheets on the discharge tray and the retracted position for allowing the sheets to move; and control means for preventing the sheet regulating means from moving from the retracted position to the regulating position when the load beyond a predetermined value is applied to the sheet regulating means. With this configuration, it is easy to remove the paper jams at the sheet transfer inlet or deeper inside of the switchback path arranged below the discharge tray. Also, it is possible to open the discharge tray without disrupting the organization or alignment of the sheets discharged on the tray when the discharge tray is moved or rotated, thereby achieving superior operability of the sheet transfer apparatus and improving the maintenance.

While the invention has been explained with reference to the specific embodiments of the invention, the explanation is illustrative and the invention is limited only by the appended claims.

What is claimed is:

1. A sheet transfer apparatus for transferring a sheet, comprising:

a discharge tray movable in a vertical direction between a first position for receiving the sheet and a second position inclined relative to the first position, interconnecting means attached to the discharge tray and activating in response to a movement of the discharge tray from the first position to the second position, and sheet regulating means responsive to the interconnecting means for regulating a movement of the sheet on the discharge tray.

2. An image reading apparatus comprising the sheet transfer apparatus according to claim 1, a platen disposed below the sheet transfer apparatus, and reading means arranged below the platen for reading an image on the sheet.

3. A sheet transfer apparatus for transferring a sheet, comprising:

a discharge tray for receiving the sheet, support means attached to the discharge tray for rotationally supporting the same, interconnecting means attached to the discharge tray and activating response to a rotation of the discharge tray, and sheet regulating means responsive to the interconnecting means and being movable between a regulating position for stopping the sheet on the discharge tray and a retracted position for allowing the sheet to move.

4. A sheet transfer apparatus according to claim 3, wherein said interconnecting means comprises cam means moving in association with the discharge tray and engaging one end of the sheet regulating means.

5. A sheet transfer apparatus according to claim 4, wherein said sheet regulating means is fixed at the regulating position when the cam means rotates beyond a predetermined angle.

6. A sheet transfer apparatus according to claim 3, further comprising control means disposed on the interconnecting means for preventing the sheet regulating means from moving to the regulating position from the retracted position even if the discharge tray is moved when the sheet regulating means receives a load greater than a predetermined load.

7. A sheet transfer apparatus according to claim 6, wherein said control means is spring means for preventing the interconnecting means from moving, even if the discharge tray is moved, by a weight of a sheet when the sheet covers the sheet regulating means.

8. A sheet transfer apparatus according to claim 6, wherein said control means is friction transmission means for preventing the interconnecting means from moving, even if the discharge tray is moved, by a weight of a sheet when the sheet covers the sheet regulating means.

9. An image reading apparatus comprising the sheet transfer apparatus according to claim 3, a platen disposed below the sheet transfer apparatus, and reading means arranged below the platen for reading an image on the sheet.

10. A sheet transfer apparatus for transferring a sheet, comprising:

a discharge tray having a first discharge tray for receiving the sheet discharged from a sheet discharge outlet, and a second discharge tray disposed adjacent to the first discharge tray, support means connected to the first discharge tray for rotationally supporting the first discharge tray to open the discharge tray, interconnecting means attached to the discharge tray and activating when the first discharge tray rotates beyond a predetermined angle, and sheet regulating means engaging the interconnecting means to be movable between a regulating position for regulating a movement of the sheet on the discharge tray and a retracted position for allowing the sheet to move.

11. A sheet transfer apparatus according to claim 10, further comprising second support means for supporting the second discharge tray to be rotatable independently of the first discharge tray, said regulating means being supported on the second discharge tray.

12. A sheet transfer apparatus according to claim 10, further comprising control means disposed on the interconnecting means for controlling a movement of the sheet regulating means from the retracted position to the regulating position when the sheet regulating means receives a load greater than a predetermined load.

13. An image reading apparatus comprising the sheet transfer apparatus according to claim 10, a platen disposed below the sheet transfer apparatus, and reading means arranged below the platen for reading an image on the sheet.

14. A sheet transfer apparatus for transferring a sheet, comprising:

a sheet supply tray for storing the sheet, transfer means disposed adjacent to the sheet supply tray for transferring the sheet along a platen for reading an image on the sheet, a switchback path disposed adjacent to the transfer means for switching back and reversing the sheet transferred from the transfer means, a discharge tray having a first discharge tray arranged above the switchback path and movable in a vertical direction between a first position for receiving the sheet and a second position for opening an entrance side of the switchback path, and a second discharge tray disposed adjacent to the first discharge tray, support means for rotationally supporting the first discharge tray to open the switchback path, interconnecting means attached to the discharge tray and activating in response to a rotation of the first discharge tray, and sheet regulating responsive attached to the interconnecting means to be moved to a regulating position for regulating the sheet on the discharge tray from a retracted position for allowing the sheet to move through an action of the interconnecting means when the first discharge tray rotates from the first position to the second position.

15. A sheet transfer apparatus according to claim 14, further comprising control means for preventing the regulating means from moving to the regulating position from the retracted position along with the rotation of the first discharge tray when the sheet straddles between the first discharge tray and the second discharge tray and is positioned above the sheet regulating means.

16. A sheet transfer apparatus according to claim 14, further comprising a main apparatus frame for rotationally supporting the first discharge tray and the second discharge tray.

17. An image reading apparatus comprising the sheet transfer apparatus according to claim 14, a reading means arranged below the platen for reading an image on the sheet, said platen being disposed below the sheet transfer apparatus.

18. A sheet transfer apparatus for transferring a sheet, comprising:

a discharge tray movable in a vertical direction between a first position for receiving the sheet and a second position inclined relative to the first position, a tray position sensor for detecting the discharge tray at the first position or the second position, sheet regulating means for regulating a movement of the sheet on the discharge tray, drive means for moving the sheet regulating means to a position to engage the sheet, a sheet sensor disposed at an upstream side of the sheet regulating means in a sheet discharge direction for detecting the sheet on the discharge tray, and control means for activating the drive means when the sheet sensor detects the sheet and the tray position sensor detects the discharge tray at the second position.

19. A sheet transfer apparatus according to claim 18, further comprising a second sheet sensor for detecting whether the sheet on the discharge tray is disposed at a downstream side over the sheet regulating means in the sheet discharge direction, said control means preventing the drive means from activating even though the tray position sensor detects the discharge tray at the second position when the second sheet sensor detects the sheet at the downstream side in the sheet discharge direction.

20. An image reading apparatus comprising the sheet transfer apparatus according to claim 18, a platen disposed below the sheet transfer apparatus, and reading means arranged below the platen for reading an image on the sheet.

* * * * *